US011445585B2

(12) United States Patent
Aronov et al.

(10) Patent No.: US 11,445,585 B2
(45) Date of Patent: Sep. 13, 2022

(54) NON-NEUTRAL-BASED, ILLUMINATED ELECTRICAL LOAD CONTROLS

(71) Applicant: Leviton Manufacturing Co., Inc., Melville, NY (US)

(72) Inventors: Aleksandr Aronov, Brooklyn, NY (US); Walter Ancipiuk, Staten Island, NY (US); Melissa Cinelli, Commack, NY (US); Timothy Lindh, Bellmore, NY (US)

(73) Assignee: LEVITON MANUFACTURING COMPANY, INC., Melville, NY (US)

( * ) Notice: Subject to any disclaimer, the term of this patent is extended or adjusted under 35 U.S.C. 154(b) by 91 days.

(21) Appl. No.: 16/942,057

(22) Filed: Jul. 29, 2020

(65) Prior Publication Data

US 2021/0298145 A1 Sep. 23, 2021

Related U.S. Application Data

(60) Provisional application No. 62/992,267, filed on Mar. 20, 2020.

(51) Int. Cl.
*H05B 45/30* (2020.01)
*H05B 45/345* (2020.01)
(Continued)

(52) U.S. Cl.
CPC ..... *H05B 45/345* (2020.01); *H01H 9/161* (2013.01); *H05B 45/39* (2020.01)

(58) Field of Classification Search
CPC ..... H05B 45/39; H05B 45/50; H05B 45/345; H05B 39/044; H05B 39/085
See application file for complete search history.

(56) References Cited

U.S. PATENT DOCUMENTS 3,250,887 A 5/1966 Sorenson
3,435,169 A 3/1969 Bienwald et al.
(Continued)

OTHER PUBLICATIONS

PCT Application No. PCT/US2021/70273, "Notification of Transmittal of the International Search Report and the Written Opinion of the International Searching Authority", dated May 25, 2021 (21 pages).

(Continued)

*Primary Examiner* — Tung X Le
(74) *Attorney, Agent, or Firm* — Kevin P. Radigan, Esq.; Heslin Rothenberg Farley & Mesiti P.C.

(57) ABSTRACT

An illuminated electrical load control is provided for controlling electrical power to a light-emitting diode (LED) lighting load. The load control includes a wall-box mounted housing, and an electrical switch assembly disposed at least partially within the housing. The switch assembly includes an actuator coupled to transition the switch assembly between an ON state, where AC current flows to the LED lighting load, and an OFF state, where current is interrupted from flowing to the LED lighting load. Further, the load control includes an illumination assembly with an indicator light to illuminate, at least in part, the load control when the switch assembly is in OFF state, and a current-limiting circuit connected across terminals of the switch assembly, and configured to limit leakage current through to the LED lighting load to below an activation current of the LED lighting load when the switch assembly is in the OFF state.

21 Claims, 22 Drawing Sheets

(51) Int. Cl.
*H01H 9/16* (2006.01)
*H05B 45/39* (2020.01)

(56) References Cited

U.S. PATENT DOCUMENTS

| | | | | |
|---|---|---|---|---|
| 3,986,022 | A | 10/1976 | Hyatt | |
| 4,654,626 | A | 3/1987 | Carsello | |
| 4,755,913 | A | 7/1988 | Sleveland | |
| 5,012,495 | A | 4/1991 | Munroe et al. | |
| 5,359,231 | A | 10/1994 | Flowers et al. | |
| 5,637,930 | A | 6/1997 | Rowen et al. | |
| 5,945,647 | A | 8/1999 | Hoskins | |
| 6,005,308 | A | 12/1999 | Bryde et al. | |
| 6,259,351 | B1 | 7/2001 | Radosavljevic et al. | |
| 6,734,381 | B2 | 5/2004 | Mayo et al. | |
| 7,170,018 | B2 | 1/2007 | Ilkhanov | |
| 7,345,998 | B2 | 3/2008 | Cregg et al. | |
| 7,400,239 | B2 | 7/2008 | Kiko et al. | |
| D603,809 | S | 11/2009 | Mathew et al. | |
| 7,663,325 | B2 | 2/2010 | McDonough et al. | |
| 7,670,039 | B2 | 3/2010 | Altonen et al. | |
| 7,777,145 | B2 | 8/2010 | Burrell et al. | |
| 7,837,344 | B2 | 11/2010 | Altonen et al. | |
| 7,985,937 | B2 | 7/2011 | Wu et al. | |
| 8,003,904 | B2 | 8/2011 | Wu | |
| 8,124,898 | B2 | 2/2012 | Mathew et al. | |
| 8,138,435 | B2 | 3/2012 | Patel et al. | |
| 8,173,920 | B2 | 5/2012 | Altonen et al. | |
| 8,367,955 | B2 | 2/2013 | Strothmann | |
| 8,459,812 | B2 | 6/2013 | Wu et al. | |
| 8,536,473 | B2 | 9/2013 | Goyal et al. | |
| 8,558,470 | B2 | 10/2013 | Shteynberg et al. | |
| 8,624,142 | B2 | 1/2014 | Mathew et al. | |
| 8,669,720 | B2 | 3/2014 | Goyal et al. | |
| 8,717,718 | B2 | 5/2014 | Kamor et al. | |
| 9,029,720 | B2 | 5/2015 | Strothmann | |
| 9,084,324 | B2 * | 7/2015 | Salvestrini | H05B 45/10 |
| 9,329,607 | B2 | 5/2016 | Kevelos et al. | |
| 9,389,769 | B1 | 7/2016 | O'Keefe | |
| 9,398,667 | B2 | 7/2016 | Kevelos et al. | |
| 9,681,526 | B2 | 6/2017 | Ostrovsky et al. | |
| 9,767,973 | B2 | 9/2017 | Kevelos et al. | |
| 9,916,946 | B1 | 3/2018 | Mathew et al. | |
| 10,062,528 | B2 | 8/2018 | Kevelos et al. | |
| 10,276,332 | B2 | 4/2019 | Jansen et al. | |
| 10,475,605 | B2 | 11/2019 | Jansen et al. | |
| 2005/0099824 | A1 | 5/2005 | Dowling et al. | |
| 2006/0255959 | A1 * | 11/2006 | Salvestrini | H05B 39/044 340/664 |
| 2007/0193863 | A1 | 8/2007 | Wu | |
| 2008/0151458 | A1 | 6/2008 | Beland et al. | |
| 2009/0256483 | A1 | 10/2009 | Gehman et al. | |
| 2010/0101924 | A1 | 4/2010 | Ono et al. | |
| 2011/0162946 | A1 * | 7/2011 | Altonen | H05B 47/10 200/33 R |
| 2012/0257316 | A1 | 10/2012 | Kamor et al. | |
| 2013/0026946 | A1 | 1/2013 | Maruyama et al. | |
| 2013/0026947 | A1 | 1/2013 | Economy et al. | |
| 2013/0162167 | A1 | 6/2013 | Marc Gallo | |
| 2013/0162168 | A1 | 6/2013 | Ostrovsky | |
| 2014/0139119 | A1 * | 5/2014 | Trolese | F21S 8/024 315/154 |
| 2014/0253483 | A1 | 9/2014 | Kupersztoch et al. | |
| 2015/0144470 | A1 | 5/2015 | Chang | |
| 2015/0181682 | A1 | 6/2015 | Shet et al. | |
| 2015/0203056 | A1 | 7/2015 | Adkins et al. | |
| 2015/0357133 | A1 | 12/2015 | Keirstead et al. | |
| 2016/0036349 | A1 * | 2/2016 | Steiner | H05B 47/10 315/307 |
| 2016/0041569 | A1 | 2/2016 | Kevelos et al. | |
| 2016/0268074 | A1 | 9/2016 | Kevelos et al. | |
| 2017/0194118 | A1 | 7/2017 | Brudzynsky et al. | |
| 2017/0265287 | A1 | 9/2017 | Avrahamy | |
| 2019/0104582 | A1 | 4/2019 | Liu et al. | |
| 2020/0366079 | A1 * | 11/2020 | Telefus | H01H 9/563 |

OTHER PUBLICATIONS

Product Brochure for the Mural Collection, Leviton Manufacturing Co., Inc., Melville, New York, (2000) (12 pages).
Product Brochure for the Mural Collection II, Leviton Manufacturing Co., Inc., Melville, New York, (2002) (7 pages).
LEVITON®, Product Specifications / Info, Product No. 6641-1 (2007) (1 page).
Product Brochure for The Claro™ Collection, Lutron Electronics Inc. (2009) (4 pages).
ENERLITES®, "General Specification, Residential Grade Lighted Toggle Switch/Single Pole", Model No. 88115L (2016) (1 page).
ENERLITES®, "General Specification, Residential Grade Decorator Switch Single Pole", Model No. 991160-W (2017) (1 page).
LEVITON®, Product Specifications / Info, Product No. 1461-LC (2018) (1 page).
LEVITON®, Product Specifications / Info, Product No. 5611-2W (2018) (2 pages).
Hubbell, "Product Description", Catalog ID: RS315ILLA (2020) (1 page).
Hubbell, Product Description, Catalog ID: RSD115 (2020) (2 pages).
Eaton Product Overview, "Eaton Standard Grade Decorator Switch", Product/Model No. 7513A-BOX (printed Aug. 2020) (2 pages).
Eaton Product Overview, "Eaton Toggle Switch", Product/Model No. 1303-7LTWBOX (printed Aug. 2020) (2 pages).
LEGRAND®/PASS & SEYMOUR® Product Specification, "radiant® Paddle Switches", Product No. TM870, TM873, TM874 (Jul. 2016) (4 pages).
LEGRAND®/PASS & SEYMOUR® Product Specification, "Legrand 15A, 120V Trademaster® Single-Sole/Illuminated Toggle Switch, Ivory", Product No. 660|SLG (printed Aug. 2020) (2 pages).
Sozulamp, Internet Product Brochure/Advertisement for "2Pack Decorator Paddle Rocker Light Switch with Night Light, 3 Wire, Residential Grade 15 Amp, 120Volt, Single-Pole SwitchLight, LED Guidelight for Bathroom, Bedroom, No Wall Plate Cover, Warm White LED", available Nov. 2019 (23 pages).

* cited by examiner

NON-NEUTRAL-BASED, ILLUMINATED ELECTRICAL LOAD CONTROLS

CROSS-REFERENCE TO RELATED APPLICATION

This application claims the benefit of U.S. provisional patent application Ser. No. 62/992,267, filed Mar. 20, 2020, entitled "Device Illumination Using a Current Limiting Circuit to Reduce Load Ghosting", the entirety of which is hereby incorporated herein by reference.

BACKGROUND

Non-neutral-based electrical load controls (or two-wire load controls), are used for controlling loads, such as lighting loads, in cases where a neutral connection is not available. The load control is typically connected electrically in-series with the load, and line power is conducted to the load when the load control's switching circuit is in the ON state (e.g., closed in the case of a single-pole switch), and not conducted to the load when in the OFF state (e.g., open in the case of a single-pole switch).

Illuminated load controls, such as illuminated switches or locator switches, allow a user to readily locate the control in the dark. Conventional non-neutral-based illuminated controls work well with incandescent lighting, halogen lighting, and non-electronic fluorescent fixtures, but are typically not used in combination with a light-emitting diode (LED) light bulb or lamp load due to flickering and/or ghosting of the LED lighting load when the load control is illuminated in the OFF state.

SUMMARY

Certain shortcomings of the prior art are overcome and additional advantages are provided through the provision, in one or more aspects, of a non-neutral-based, illuminated electrical load control for controlling a source of AC electrical power to a light-emitting diode (LED) lighting load. The non-neutral-based, illuminated electrical load control includes a wall-box mounted housing, and an electrical switch assembly disposed at least partially within the wall-box mounted housing. The electrical switch assembly includes an actuator coupled to transition the electrical switch assembly between an ON state and an OFF state, where AC current flows through the LED lighting load in the ON state, and is interrupted from flowing to the LED lighting load in the OFF state. The electrical load control further includes an illumination assembly associated with the electrical switch assembly. The illumination assembly includes an indicator light that illuminates, at least in part, the non-neutral, illuminated electrical load control when the electrical switch assembly is in the OFF state, and a current-limiting circuit electrically connected across terminals of the electrical switch assembly. The current-limiting circuit is configured to limit leakage current through the illumination assembly to the LED lighting load to below an activation current of the LED lighting load when the electrical switch assembly is in the OFF state and the indicator light provides illumination.

In another aspect, a non-neutral-based, illuminated electrical load control is provided for controlling a source of AC electrical power to a light-emitting diode (LED) lighting load. The non-neutral-based, illuminated electrical load control includes a wall-box mounted housing, and an electrical switch assembly disposed at least partially within the wall-box mounted housing. The electrical switch assembly includes an actuator coupled to transition the electrical switch assembly between an ON state and an OFF state, where AC current flows to the LED lighting load in the ON state, and is interrupted from flowing to the LED lighting load in the OFF state. The electrical load control further includes an illumination assembly associated with the electrical switch assembly. The illumination assembly includes: a light-emitting diode (LED) indicator light that illuminates, at least in part, the non-neutral, illuminated electrical load control when the electrical switch assembly is in the OFF state; a current-limiting circuit electrically connected across terminals of the electrical switch assembly; and an AC-to-DC converter providing DC current to the LED indicator light when the electrical switch assembly is in the OFF state and the indicator light provides illumination. The current-limiting circuit is configured to limit leakage current through the illumination assembly to the LED lighting load to below an activation current of the LED lighting load when the electrical switch assembly is in the OFF state and the indicator light provides illumination.

In a further aspect, a non-neutral-based, illuminated electrical load control is provided for controlling a source of AC electrical power to a light-emitting diode (LED) lighting load. The non-neutral-based, illuminated electrical load control includes a wall-box mounted housing, and an electrical switch assembly disposed at least partially within the wall-box mounted housing. The electrical switch assembly includes an actuator coupled to transition the electrical switch assembly between an ON state and an OFF state, where AC current flows to the LED lighting load in the ON state, and is interrupted from flowing to the LED lighting load in the OFF state. Further, the electrical load control includes an illumination assembly associated with the electrical switch assembly. The illumination assembly includes: a circuit board disposed within the wall-box mounted housing; and an indicator light that illuminates, at least in part, the non-neutral, illuminated electrical load control when the electrical switch assembly is in the OFF state, the indicator light being coupled to the circuit board. Further, the illumination assembly includes a current-limiting circuit electrically connected across terminals of the electrical switch assembly. The current-limiting circuit is configured to limit leakage current through the illumination assembly to the LED lighting load to below an activation current of the LED lighting load when the electrical switch assembly is in the OFF state and the indicator light provides illumination.

Additional features and advantages are realized through the techniques described herein. Other embodiments and aspects of the invention are described in detail herein and are considered a part of the claimed aspects.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
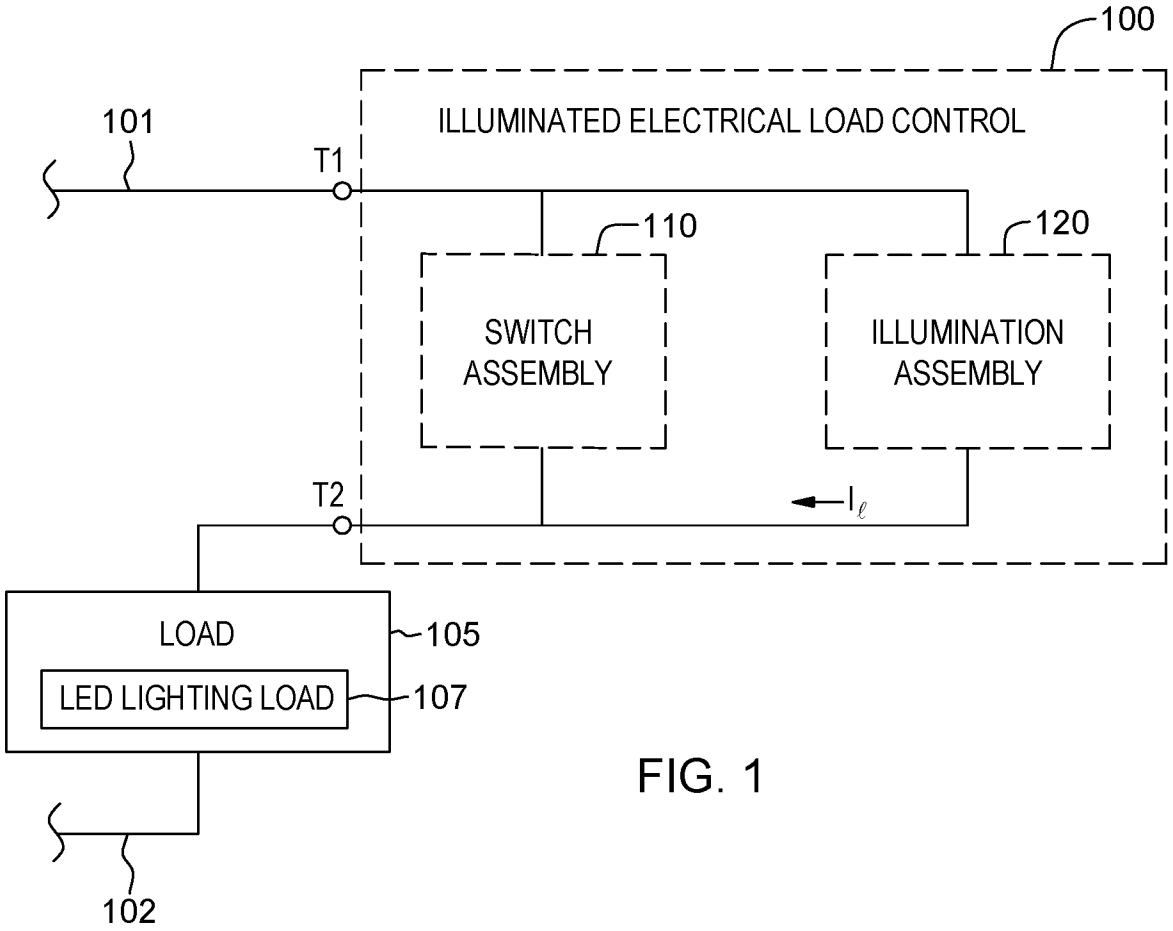
FIG. 1 is a schematic of one embodiment of a non-neutral-based, or two-wire, illuminated electrical load control, in accordance with one or more aspects of the present invention.

The accompanying figures, in which like reference numerals refer to identical or functionally similar elements throughout the separate views, illustrate embodiments of the present invention, and together with this detailed description of the invention, serve to explain aspects of the present invention. Note in this regard that, descriptions of well-known systems, devices, components, fabrication techniques, etc., are omitted so as not to unnecessarily obscure the invention in detail. It should be understood, however, that the detailed description and the specific example(s), while indicating aspects of the invention, are given by way of illustration only, and not limitation. Various substitutions, modifications, additions, and/or other arrangements, within the spirit or scope of the underlying inventive concepts will be apparent to those skilled in the art from this disclosure. Note further that numerous inventive aspects and features are disclosed herein, and unless inconsistent, each disclosed aspect or feature is combinable within the other disclosed aspect or feature as desired for a particular application of the concepts disclosed herein.

Non-neutral-based, or two-wire, electrical load controls are used for controlling loads, such as lighting loads, in cases where a neutral wire or connection is not available at the switch assembly. Note that the neutral wire is different from the ground or Earth-wire, which plays no active role in the typical operation of the non-neutral-based, electrical load control. A non-neutral-based load control, such as a non-neutral-based electrical switch assembly, is typically connected electrically in-series with the load. In the case of a single-pole switch, line power is conducted to the load when the load control's switching circuit is closed (or in the ON state), and not conducted to the load when open (or in the OFF state). Note that although principally described herein in connection with electrical switch assemblies, the electrical load control can be, in one or more other embodiments, any one of a variety of electrical lighting controls for controlling electrical power to a lighting load, such as a light-emitting diode (LED) lighting load. For instance, the concepts disclosed herein can apply to and be implemented within non-neutral-based dimmers, occupancy sensors, or other non-neutral-based, or two-wire, lighting controls.

Illuminated load controls, such as illuminated switches, or locator switches, allow a user to readily locate the control in the dark. As noted, non-neutral-based illuminated controls work well with incandescent lighting, halogen lighting, and non-electronic fluorescent fixtures, but are typically unable to be used in combination with a light-emitting diode (LED) lighting load, such as an LED light bulb or LED lamp, due to strobing and/or ghosting of the lighting load when the non-neutral-based load control illuminates in the OFF state. This is because the current required to energize the indicator light within the illuminated switch leaks to the lighting load, which charges the internal driver of the LED light bulb until the voltage across it rises to the point where it attempts to turn the LED light bulb ON. This cycle can repeat indefinitely, resulting in a repetitive, brief flashing of the LED lighting load while the switch is illuminated in the OFF state. Ghosting can occur where the current passing through the illumination circuit is sufficient to activate the driver and maintain the LED lighting load ON at a low level.

Another issue addressed herein with illuminated load controls is that when illuminating the load control, the indicator light can flicker, which can occur due to one or more circuit drivers of the LED lighting load being current-starved, in which case the circuit driver(s) continues to charge and attempt to turn the LED load ON. During this process of the LED load drawing a faint current, there is a voltage drop across the load, and this in turn causes the indicator light intensity to alter, and it appears to flicker because the indicator circuit has a fixed impedance and if the voltage across the indicator light changes, then the current to the illumination circuit changes. Hence, the current to the indicator light dips and recovers, and the cycle repeats and, from a user's perspective, it appears as if the indicator light is flickering.

Addressing these issues, disclosed herein is an electrical load control which includes, in one embodiment, an electrical switch assembly for controlling electrical power to a load, and an illumination assembly associated with the electrical switch assembly. The electrical switch assembly is a non-neutral-based, or two-wire, switch assembly, and the load includes a light-emitting diode (LED) lighting load, such as a commercially available LED light bulb or lamp. The illumination assembly includes an indicator light to illuminate, at least in part, the electrical load control when the electrical switch assembly is in the OFF state, and a current-limiting circuit. The current-limiting circuit is configured to limit leakage current through the illumination assembly to the LED lighting load to below an activation current of the driver of the LED lighting load when the electrical switch assembly is in the OFF state and the indicator light provides illumination.

For instance, in one embodiment, a current-limiting circuit for a standard US premise voltage of 120 volts includes one or more resistors sized so that resistance through the illumination assembly is 60 kΩ or greater, limiting current through the illumination assembly to 2 mA or less through to the LED lighting load. At this current level, the majority of LED industry light bulbs have been found to not strobe or ghost when the electrical switch assembly is in the OFF state and the indicator light provides illumination. To resolve any possible indicator light flicker, resistance through the indicator circuit can be further increased to, for instance, 120 kΩ or greater, which at this level, the indicator circuit significantly suppresses leakage current to 1 mA or less, and for most of the LED lighting industry, the associated LED load drivers have been found to stop operating, or attempting to activate.

FIG. 1 depicts one embodiment of a non-neutral-based, illuminated electrical load control 100, in accordance with one or more aspects disclosed herein. Illuminated electrical load control 100 includes, in one implementation, a first terminal T1 electrically coupled to a conductor 101 of a non-neutral-based, or two-wire power source, and a second terminal T2 electrically connected to a load 105 such that the illuminated electrical load control 100 and load 105 are electrically coupled in-series between conductors 101 and 102 of a premise's non-neutral-based electrical wiring. In one or more embodiments, load 105 includes an LED lighting load 107, such as a commercially available LED light bulb or lamp.

As depicted in FIG. 1, within illuminated electrical load control 100, an illumination assembly 120 is electrically coupled in parallel with an electrical lighting control, such as an electrical switch assembly 110, to illuminate, at least in part, electrical switch assembly 110 when the electrical switch assembly is in an OFF state. For instance, in one embodiment, illumination assembly 120 backlight-illuminates, at least in part, switch assembly 110 when the electrical switch assembly is in the OFF state to assist a user in locating the electrical switch assembly in the dark. In one or more implementations, illumination assembly 120 is configured and located to backlight, at least in part, a cover and/or an actuator of the electrical load control, such as a region of the cover adjacent to the actuator of the electrical switch assembly, or the actuator itself, when the electrical switch assembly is in the OFF state. When in the ON state, current flows through the electrical switch assembly 110, and in the OFF state, a predetermined, small amount of current $I_l$ sufficient to illuminate the illumination assembly's indicator light is allowed to leak through illumination assembly 120. In particular, in one or more implementations, illumination assembly 120 includes a current-limiting circuit which limits leakage current $I_l$ through the illumination assembly to LED lighting load 105 to below an activation current of a driver of the LED lighting load when the electrical switch assembly is in the OFF state and the indicator light provides illumination.

Figure 2:
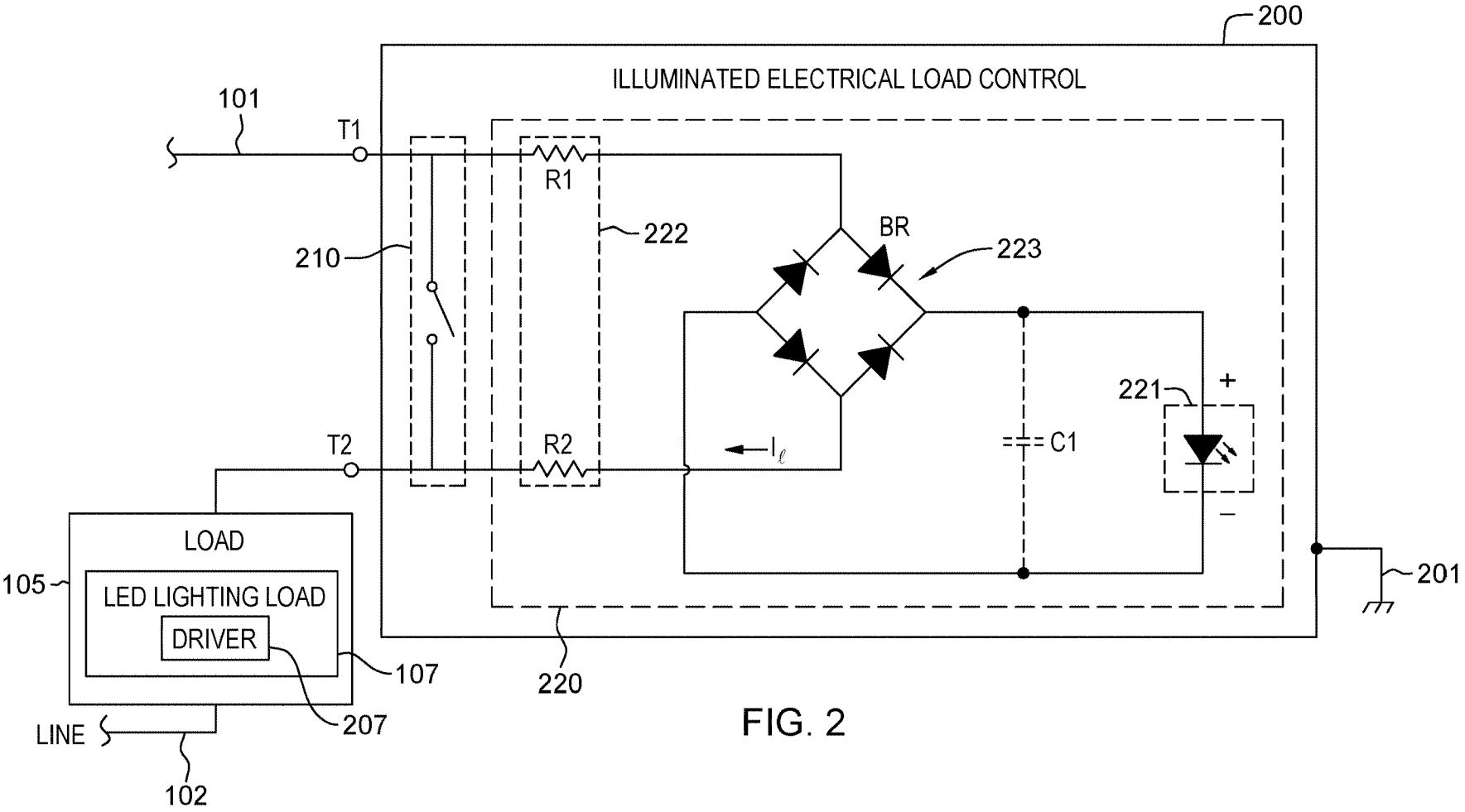
FIG. 2 is a more detailed schematic of one embodiment of a non-neutral-based, or two-wire, illuminated electrical load control, in accordance with one or more aspects of the present invention.

FIG. 2 illustrates is a more detailed embodiment of an illuminated electrical load control 200, in accordance with one or more aspects of the present invention. Illuminated electrical load control 200 is a non-neutral-based electrical load control which includes first terminal T1 electrically coupled to conductor 101 of a two-wire electrical power source, and second terminal T2 electrically connected to load 105 so that illuminated electrical load control 200 and load 105 are electrically coupled in-series between conductors 101, 102 of a premise's power source. In the depicted implementation, load 105 includes a light-emitting diode (LED) lighting load 107, with an associated driver 207 (or activation circuit) for turning LED lighting load 107 ON when a specified activation current is received. By way of example, LED lighting load 107 includes one or more commercially available LED light bulbs, LED lamps, LED panel lights, LED tube lights, etc. In one or more embodiments, the LED light load is, for instance, a solid-state lighting (SSL) device that fits in a standard lighting connection, but uses light-emitting diodes (LEDs) to produce light. By way of example only, an LED lighting load might include an equivalent LED light bulb to a standard 40-watt incandescent bulb, 60-watt incandescent bulb, 100-watt incandescent bulb, etc. Such LED lighting loads 107 have an internal electrical circuit, or LED driver 207, which facilitates powering and operation of the light-emitting diode (LED). In operation, the LED driver 207 requires an activation current/voltage in order to light the load's light-emitting diode(s).

In one embodiment, illuminated electrical load control 200 includes an electrical switch assembly 210 and an illumination assembly 220 connected in parallel, as in the embodiment of FIG. 1. Illumination assembly 220 includes an indicator light, such as an LED indicator light 221, which receives DC current from an AC-to-DC converter 223, or bridge rectifier (BR). In the depicted implementation, AC-to-DC converter 223 is shown, by way of example only, as a diode bridge, with an arrangement of four (or more) diodes in a bridge circuit configuration that provides the same polarity of output at either polarity of input. The bridge rectifier provides full wave rectification from a two-wire AC input. Further, in one or more embodiments, indicator light 221 is an ultrabright LED indicator light driven by a low voltage from AC-to-DC converter 223. The ultrabright LED indicator light is driven at a very low current, for instance, at a 2 mA or below level, such as a sub-mA level, as described herein. In one or more embodiments, AC-to-DC converter 223 and LED indicator light 221 are both selected to function at a low current level in the range of a few hundred microAmps (μA), up to 1 or 2 mA. For instance, in the case of an LED indicator light, the indicator light can be a bright light capable of producing an illuminated intensity of 1000 mcd (millicandela) or more, with an LED test current at, for instance, 5 mA. In operation, however, the illumination intensity is less since the LED indicator light is being driven at a very low current, as disclosed herein. Note, however, that depending on the application of the intensity, or how much light is needed, the millicandela (or lux level) can vary. Regardless of the intensity, the LED indicator light is selected to have the light's dye, for instance, silicone dye, turn on mostly, if not completely, when the electrical switch assembly is in the OFF state, and the indicator light provides illumination.

In accordance with one or more aspects disclosed herein, a current-limiting circuit 222 is provided as part of the illumination assembly to limit leakage current $I_l$ through illumination assembly 220 to LED lighting load 107 to below the activation current of driver 207 of LED lighting load 107 when electrical switch assembly 210 is in the OFF state, while still allowing indicator light 221 to provide location illumination to the switch assembly. This is achieved by selecting the series resistance through current-limiting circuit 222 to be sufficiently high so that the current supplied to indicator light 221, and thus the leakage current $I_l$ through illumination assembly 220, is below the activation current of the LED load's driver 207. The activation current for the driver can be experimentally predetermined, in one embodiment. By limiting the leakage current $I_l$ through illumination assembly 220 to, for instance, 2 mA or below, it has been found that the leakage current through the illumination assembly is too low to turn ON the LED lighting load 107, thereby avoiding any strobing or ghosting of the LED lighting load due to illuminating of the electrical switch assembly when the electrical switch assembly is in the OFF state. In addition, by further limiting the leakage current $I_l$ though illumination assembly 220 to, for instance, 1 mA or below, such as 0.5 mA or below (e.g., approximately 0.3 mA), internal load drivers in most commercially available LED lighting loads have been found to stop attempting to activate, thereby eliminating any appearance of flickering at the indicator light 221.

In one implementation, for conventional two-wire, 120 volt premise wiring, when series resistance through illumination assembly 220 is over 60 kΩ, the majority of available LED industry lighting loads will not strobe or ghost. At this resistance level, the current leakage to the LED load would be 2 mA or less. By further increasing series resistance through the illumination assembly to, for instance 120 kΩ or greater, the leakage current is limited to 1 mA or less, which as noted is a current level at which the LED load drivers have been found to stop operating. By way of example only, in the embodiment of FIG. 2, current-limiting circuit 222 includes a first resistor R1 and a second resistor R2 which, in one embodiment, can be of a same resistance value, such as 30 kΩ (to achieve a series resistance through the illumination assembly of 60 kΩ) or 60 kΩ, or greater (to achieve a series resistance through the illumination assembly of 120 kΩ, or greater).

As shown, a capacitor Cl, such as a 0.1-1.0 μF capacitor, can optionally be provided across LED indicator light 221 to further reduce or eliminate any flickering at the LED indicator light 221 due to AC ripple, by allowing the LED indicator to have a smoother DC level, that is, should changes in voltage across the indicator light be an issue. Further, illuminated electrical load control 200 can include a ground (or Earth-wire) 201 to electrically ground the illuminated electrical load control.

Note although described herein in connection with LED indicator light 221, that the indicator light within the illumination assembly can be any one of a variety of types of indicator lights. Further, note that the electrical load control disclosed herein can be embodied in a variety of formats, including, for instance, as a single-pole illuminated toggle or rocker switch, as a three-way illuminated toggle or rocker switch, or as a four-way illuminated toggle or rocker switch. Further, as discussed, the illuminated electrical load control can more generally be an electrical lighting control, such as a non-neutral-based, or two-wire, illuminated dimmer, a non-neutral-based, illuminated occupancy sensor, or other non-neutral-based lighting control.

By way of example, FIGS. 3A-6G depict various implementations of illuminated electrical load controls, in accordance with one or more aspects disclosed herein. FIGS. 3A-3G depict one embodiment of a non-neutral-based, single-pole (or single-way), illuminated toggle switch, FIGS. 4A-4G depict one embodiment of a three-way, illuminated toggle switch, FIGS. 5A-5G depict one embodiment of a single-pole (or single-way), illuminated rocker switch, and FIGS. 6A-6G depict one embodiment of a three-way, illuminated rocker switch. Note that these switch embodiments are provided by way of example only.

Referring collectively first to FIGS. 3A-3G, one embodiment of a single-pole (or single-way) illuminated toggle switch, in accordance with one or more aspects disclosed herein, is depicted. In this single-pole electrical switch embodiment, one terminal, such as a first terminal T1, is always connected to the power source, and the electrical switch flips between opening and closing the connection of terminal T1 to the second terminal T2 when the actuator is engaged. In the illuminated switch embodiment of FIGS. 3A-3G, for the indicator light to be ON, and the LED lighting load to be OFF, the switch is in an open state. When in this position, power is connected to the illumination assembly, which as noted is designed so that only a predetermined, small leakage current (e.g., 2 mA) is allowed to pass through to the LED lighting load. For the indicator light to be OFF, and the LED lighting load ON, the switch is in a closed state, with second terminal T2 connected to first terminal T1, so that AC power passes directly through the switch assembly to the LED lighting load, and since current flows through the path of least resistance, the indicator light of the illumination assembly is OFF.

Figure 3A:
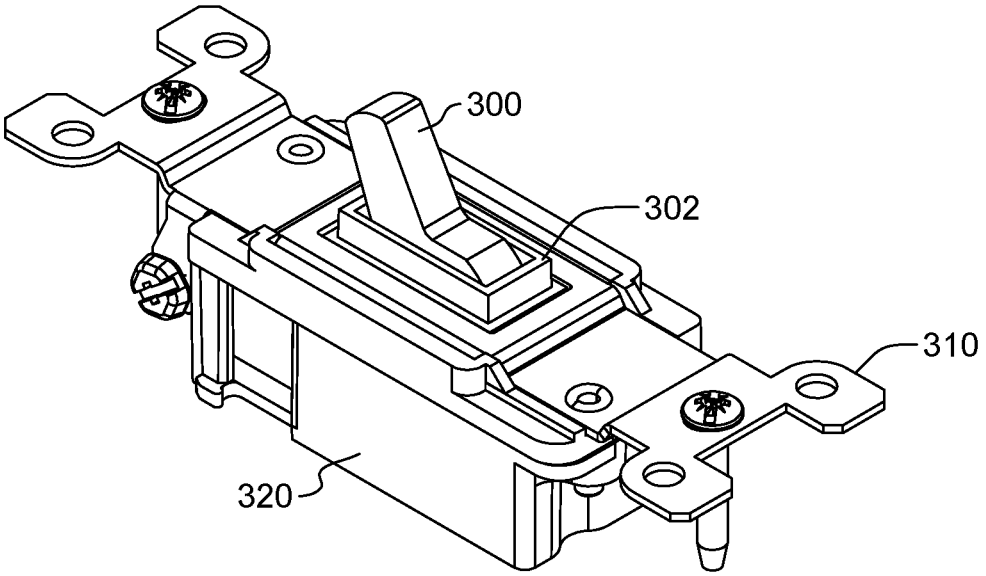
FIGS. 3A-3G depict one embodiment a single-pole, non-neutral-based, illuminated electrical switch for controlling a light-emitting diode (LED) lighting load, such as an LED light bulb or lamp load, in accordance with one or more aspects of the present invention.
Figure 3B:
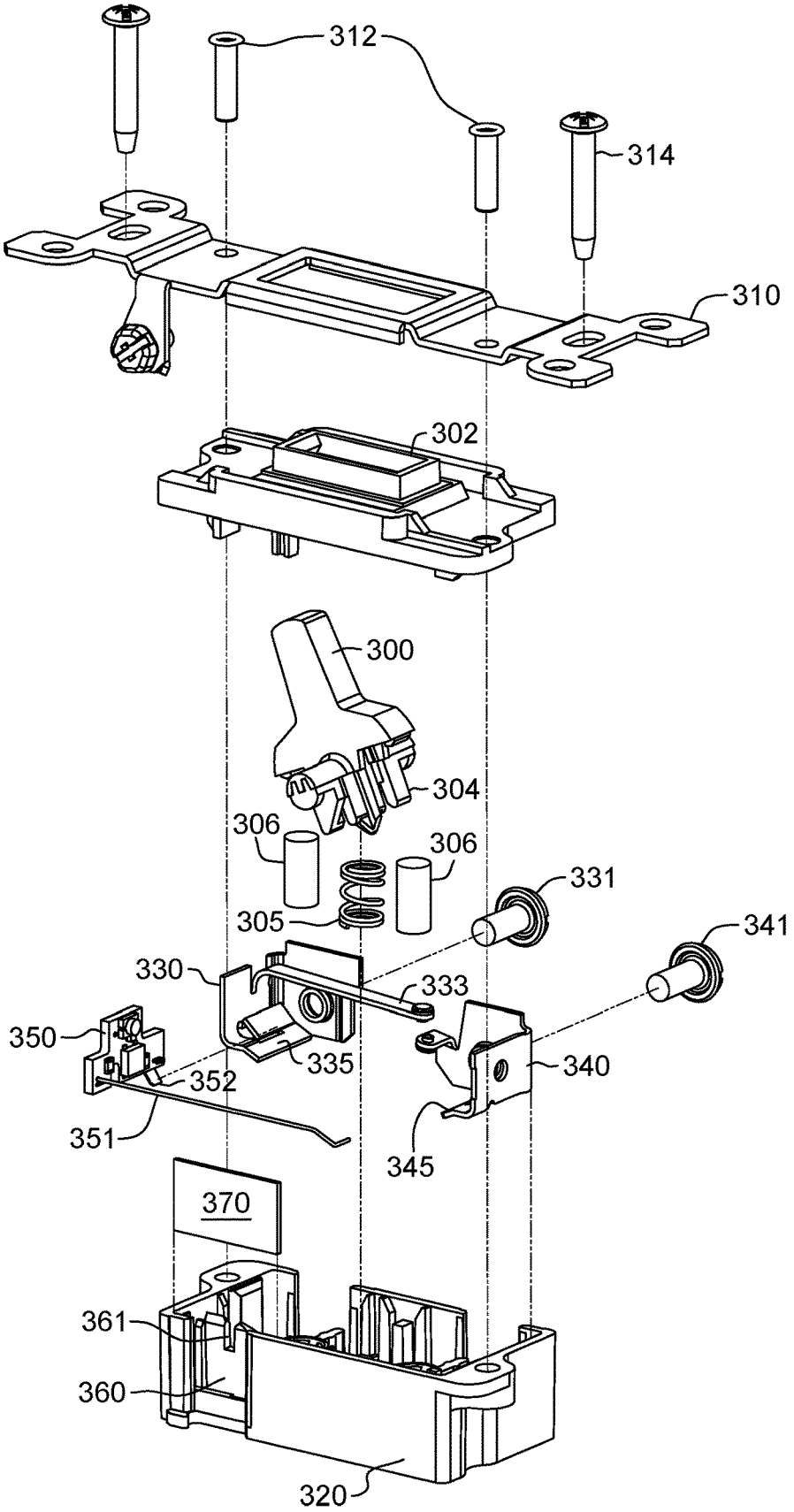

As illustrated, the single-pole illuminated toggle switch embodiment of FIGS. 3A-3G includes a toggle-type actuator 300 movable by a user to switch the electrical load control between, for instance, an ON state and an OFF state. In one embodiment, actuator 300 extends through a central opening in a cover 302, with a strapping 310 being provided, in one embodiment, to mount the assembly via fasteners 314 to a wall box. As illustrated in FIG. 3B, additional fasteners, such as rivets 312, are provided in one embodiment to fasten strapping 310 and cover 302 to a base housing 320 of the electrical load control with one or more components of the electrical switch assembly and illumination assembly disposed therebetween. In one embodiment, base housing 320, and cover 302, are formed of an insulative material, and actuator 300 is, for instance, a plastic actuator. Further, in one embodiment, strapping 310 is a metal strapping.

As shown in FIG. 3B, the electrical switch assembly of the load control includes a first terminal (T1) 330 and a second terminal (T2) 340 which receive respective terminal fasteners 331, 341, to facilitate electrically side-connecting, for instance, the electrical load control to a line conductor of a two-wire power source. In one embodiment, first terminal 330 includes a lower extension or flange 335, and second terminal 340 includes a lower extension or flange 345, which may be provided, in one or more embodiments, to facilitate an alternate back-wiring of conductors into the electrical load control (i.e., rather than side-wiring to the load control using terminal fasteners 331, 341). For instance, clamps can be provided in association with the lower extensions or flanges 335, 345 of first and second terminals 330, 340 to facilitate back-wiring connections to the load control. In one embodiment, first and second terminals 330, 340, along with terminal fasteners 331, 341, are respective metal contact structures, such as brass or copper contact structures.

In the embodiment of FIG. 3B, actuator 300 includes a push member 304 at a base of actuator 300 sized and configured to contact and push on a moving or shorting terminal arm 333 of first terminal 330. In one embodiment, terminal arm 333 is biased in closed contact with a respective electrical contact 343 of second terminal 340, and push member 304 of actuator 300 moves shorting arm 333 away from electrical connection with electrical contact 343 with switching of the actuator to its OFF position. In the embodiment depicted, actuator 300 rests on an actuator spring or toggle spring 305, which is, for instance, a steel spring at the base of the actuator that assists a user in switching actuator 300 between its ON and OFF positions. In one implementation, actuator 300 can contact respective rubber stoppers 306 at the different ON and OFF positions.

In one or more embodiments, the illumination assembly is implemented, at least in part, on a small circuit board 350 that electrically contacts first and second terminals 330, 340, for example, at lower flanges 335, 345, via respective metal contact structures 352, 351 extending from circuit board 350 and electrically, operatively coupled to the circuitry of circuit board 350. In the single-way illuminated toggle switch embodiment of FIGS. 3A-3G, contact structures 352, 351 are differently configured due to the location of the different terminals 330, 340 of the electrical switch assembly to which they contact when circuit board 350 is placed or "dropped" into operative position within the base housing 320, and held in position by affixing cover 302 to base housing 320.

Figure 3C:
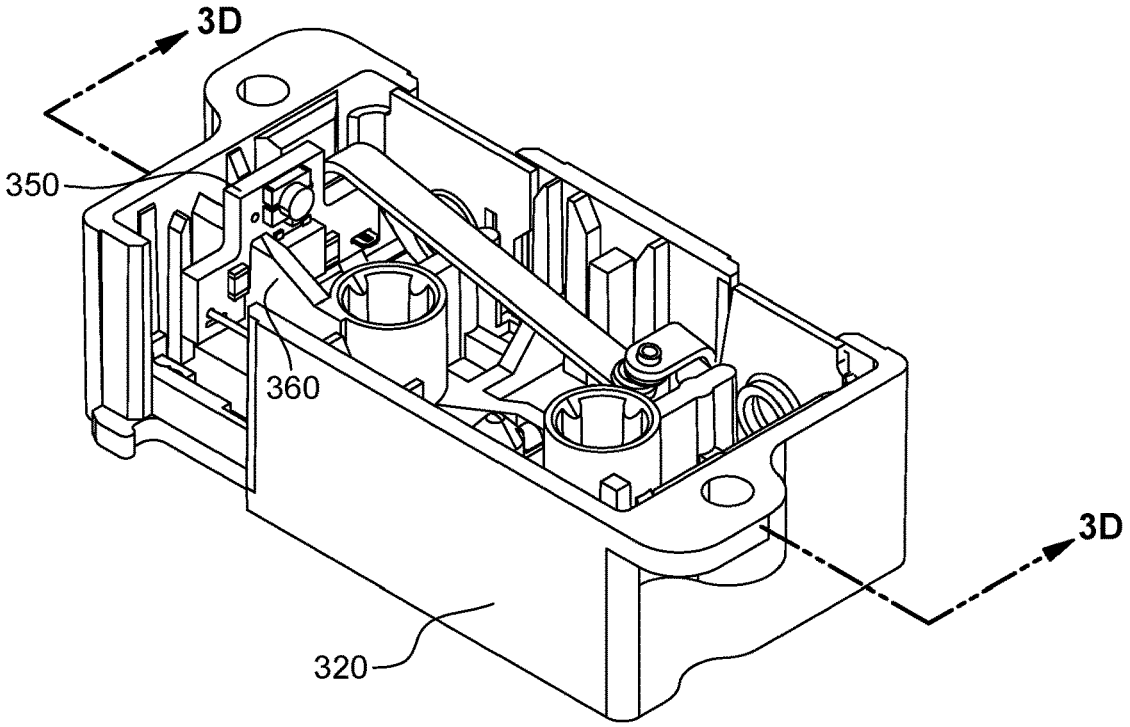
Figure 3D:
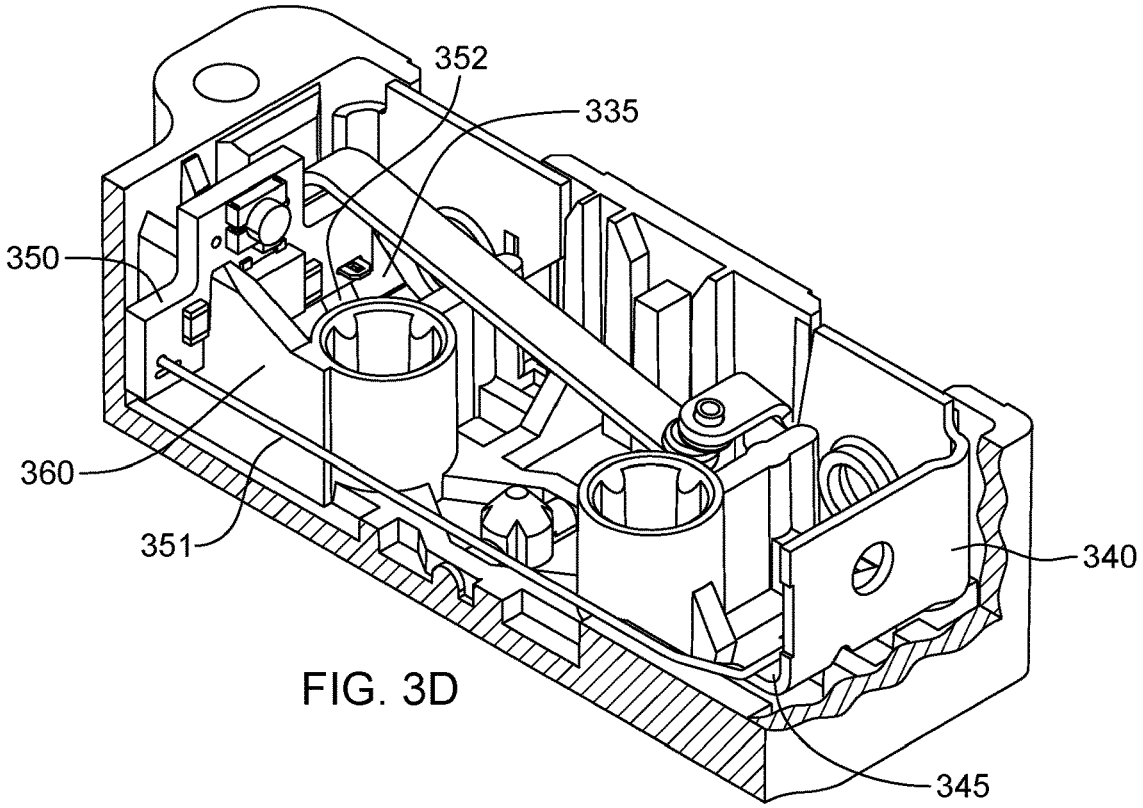

In the embodiment of FIGS. 3A-3G, circuit board 350 is oriented vertically within the housing, by way of example only. In one embodiment, a dividing wall or rib 360, such as an isolation fin, within base housing 320 includes a groove 361 sized to receive circuit board 350, as depicted in FIGS. 3C & 3D. Further, in one embodiment, circuit board 350 includes a groove 358 (see FIG. 3E), sized and configured to receive dividing wall 360 when circuit board 350 is placed into position within base housing 320, as illustrated in FIGS. 3C & 3D. In this manner, the grooves in circuit board 350 and dividing wall 360 allow the circuit board to slip over and mechanically couple to dividing wall 360, with the circuit board disposed in a vertical orientation within the housing, as shown. Note that, as circuit board 350 is slid over dividing wall 360 in operative position within base housing 320, contact structure 352 engages and pushes against lower flange 335 of first terminal 330, and contact structure 351 engages lower flange 345 of second terminal 340 to ensure good electrical connection of the circuit board's contact structures to the first and second terminals. As illustrated in FIG. 3B, an insulator member 370 can be provided in base housing 320, in the case where base housing 320 is used in a single-wire, single-pole switch implementation as discussed, but is also configured for use in a three-way switch implementation, such as illustrated in FIGS. 4A-4G.

Figure 3E:
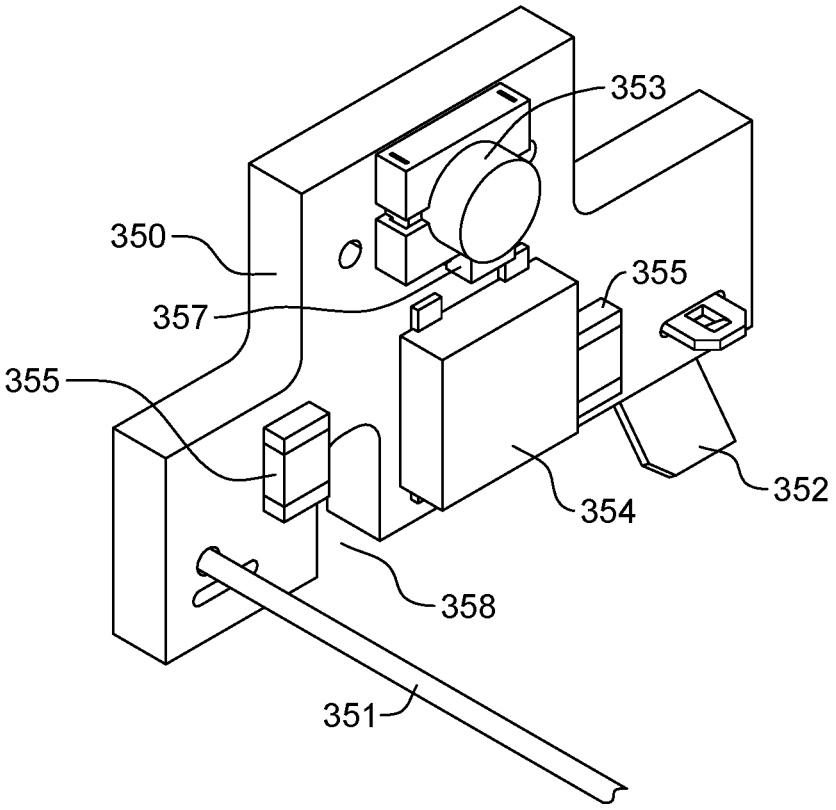

FIG. 3E is an enlarged depiction of one embodiment of circuit board 350, with metal contact structures 352 and 351 shown extending from circuit board 350 to facilitate connecting the circuit board to the first and second terminals, as noted. In the embodiment depicted, circuit board 350 includes a surface-mount indicator light, such as a surface-mount LED indicator light 353, as well as an AC-to-DC converter 354, and a current-limiting circuit, which can include (in one embodiment) first and second resistors 355, such as resistors R1, R2 connected in a current-limiting circuit as described above in connection with FIG. 2. In addition, a capacitor 357 can optionally be provided in parallel with the indicator light, as discussed above in connection with FIG. 2. In one implementation, circuit board 350 is a single-layer printed circuit board with a circuit configured to implement an illumination assembly such as illumination assembly 220 described above in connection with the illuminated electrical load control 200 of FIG. 2 using LED indicator light 353, AC-to-DC converter 354, resistors 355, and optionally, capacitor 357.

Figure 3F:
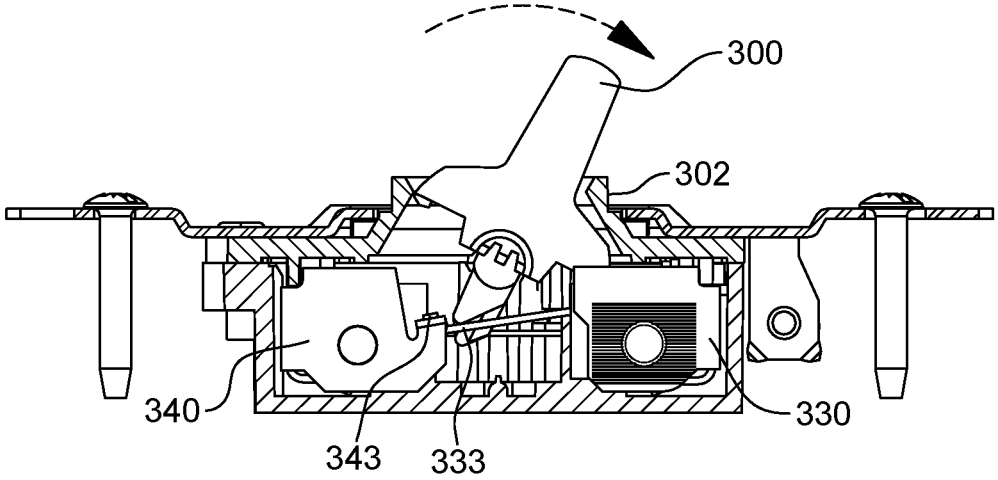
Figure 3G:
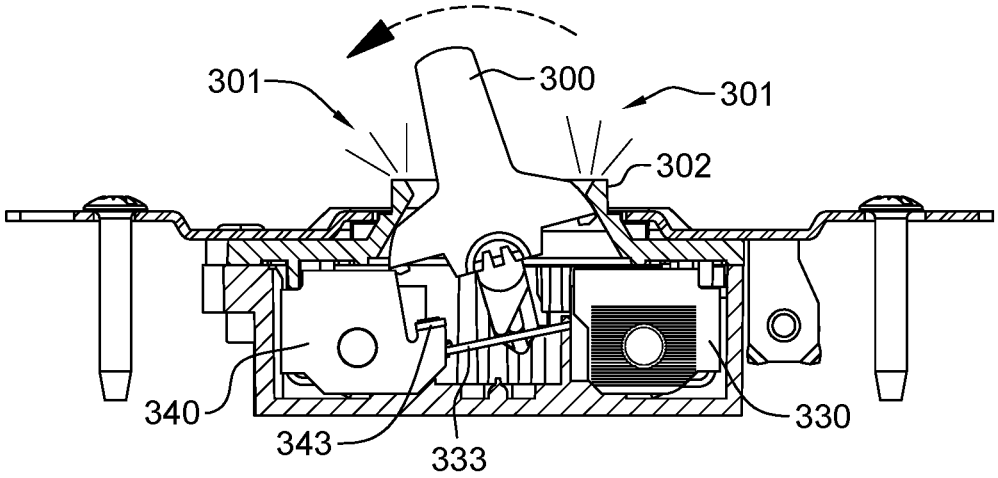

FIGS. 3F & 3G illustrate operation of the single-pole, illuminated switch. With transitioning of actuator 300 to an ON position, actuator 300 allows shorting arm 333 of first terminal 330 to move (or spring) into contact with electrical contact 343 of second terminal 340. In this ON state, electrical current flows directly through the electrical switch assembly to the load, and not through the illumination assembly. In FIG. 3G, actuator 300 is switched to the OFF state, where actuator 300 pushes shorting arm 333 of first terminal 330 away from electrical contact 343 of second terminal 340, opening the electrical switch connection, and transitioning the electrical switch assembly to the OFF state. In the OFF state, a predetermined, small amount of current is allowed by the current-limiting circuit to flow through the illumination assembly, with the amount of current being preselected as sufficient to illuminate the indicator light and provide illumination 301 to, for instance, the cover or the actuator of the load control, while being too low a current level to activate the driver of the LED lighting load, as described above in connection with FIG. 2. Note that, if desired, the cover and/or the actuator can be manufactured, at least in part, of a translucent material, such as a translucent plastic. Further, if desired, one or more light pipes or other light-conducting or light-directing structures can be utilized within the housing to direct light from the indicator light to the desired location at, for instance, the cover or actuator. In one implementation, light 301 passes through the rim of cover 302 through which actuator 300 extends, as illustrated in FIG. 3G, or passes between the rim of cover 302 and actuator 300 when the indicator light is providing illumination.

FIGS. 4A-4G depict one embodiment of a three-way, non-neutral-based, illuminated toggle switch for controlling a light-emitting diode (LED) lighting load, such as an LED light bulb or lamp, as described herein. Unless otherwise indicated, components of the three-way illuminated toggle switch embodiment of FIGS. 4A-4G are similar or identical to the single-pole illuminated toggle switch embodiment described above in connection with FIGS. 3A-3G. One difference is that, in a three-way switch configuration, two three-way switches (SW1, SW2) are electrically coupled in-series with the LED lighting load.

As shown in FIGS. 4A-4G, the three-way, non-neutral-based, illuminated toggle switch embodiment includes first terminal (T1) 330, a second terminal (T2) 340', and a third terminal (T3) 400, each of which accommodates respective fasteners 331, 341, 401, which facilitate, for instance, electrically side-connecting the illuminated switch (SW1) in a three-way wired configuration with another illuminated switch (SW2) and the LED lighting load. In this three-way switch embodiment, second terminal T2 340' is always connected, with the actuator changing electrical contact of terminal T2 between first terminal T1 330 and third thermal T3 400.

By way of example, in one three-way illuminated switch embodiment, the second terminals T2 340' of two three-way illuminated switches (SW1, SW2) can be wired together, as can the third terminals T3 400. For the switches' indicator lights to be ON, and the load to be OFF, the first switch SW1 can connect the first and third terminals T1 & T3, and the second switch SW2 can connect the first and second terminals T1 & T2, or switch SW1 can connect terminals T1 & T2, and switch SW2 can connect terminals T1 & T3. When in these switch positions, a predefined amount of AC power (limited by the respective series-connected current-limiting circuits) passes through the illumination assemblies, illuminating the respective indicator lights, and resulting in a small leakage current to the LED lighting load, constrained as described herein to a level below the activation current level of the LED lighting load driver(s) (e.g., in a range of ≤2 mA, and in particular, ≤1 mA).

Figure 4A:
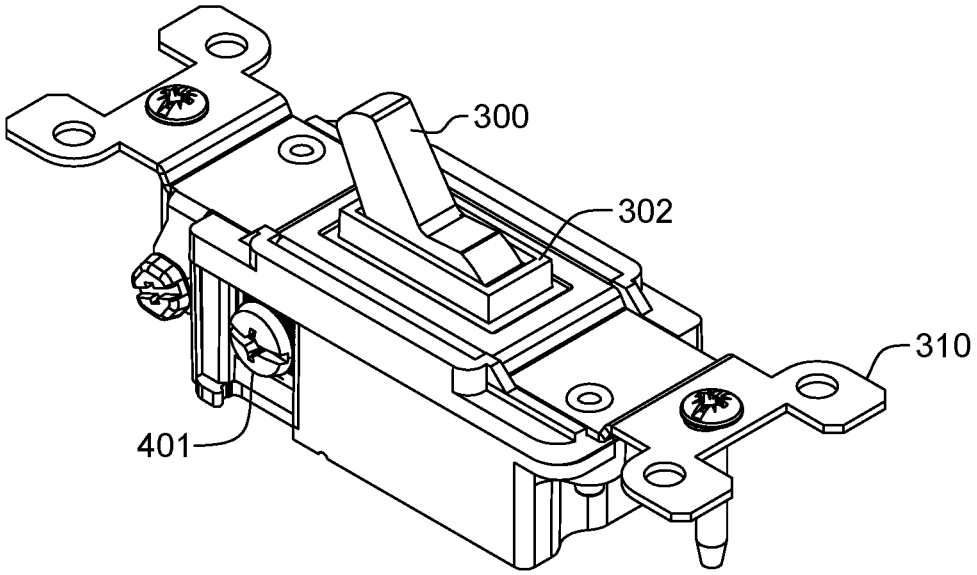
FIGS. 4A-4G depict one embodiment of a three-way, non-neutral-based, illuminated electrical switch for controlling a light-emitting diode (LED) lighting load, such as an LED light bulb or lamp load, in accordance with one or more aspects of the present invention.
Figure 4B:
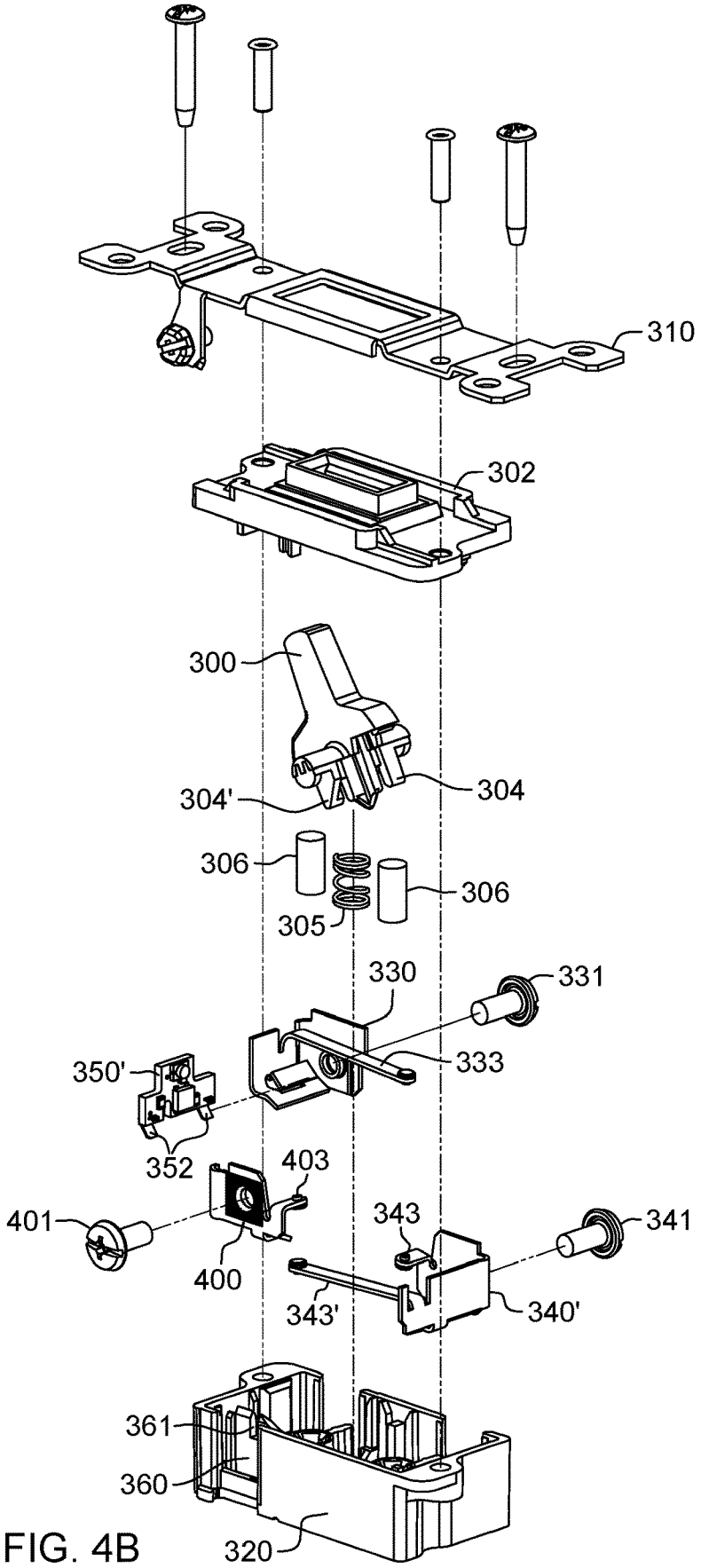

As shown in FIG. 4B, actuator 300 includes a first push member 304 and a second push member 304' at the base of actuator 300 sized and configured to contact and push on respective movable shorting arms 333, 343' of first terminal 330, and second terminal 340', respectively. In one embodiment, when the respective push member of actuator 300 allows, shorting arm 333 is biased in closed contact with the respective electrical contact 343 of second terminal 340', and shorting arm 343' is biased in closed contact with a respective electrical contact 403 of third terminal 400. As in the embodiment of FIGS. 3A-3G, actuator 300 can rest on an actuator spring 305 to assist a user in switching actuator 300 between the different switch positions, and can contact respective rubber stoppers 306 at the different switch positions.

In one embodiment, first terminal 330 and third terminal 400 include respective lower flanges engaged by respective electrical contact structures 352 (e.g., electrical contact tabs)

of circuit board 350' to electrically couple the circuitry of the illumination assembly in parallel with the electrical switch assembly. In the three-way illuminated toggle switch embodiment depicted, electrical contact structures 352 are similarly configured tabs that are electrically, operatively coupled to the circuitry of circuit board 350'. Note that circuit board 350' is, in one embodiment, a printed circuit board, such as a single-layer, printed circuit board, implementing an illumination assembly circuit embodiment similar to that described above in connection with FIG. 2. As with circuit board 350 embodiment of FIGS. 3A-3G, circuit board 350' is coupled so that when the electrical switch assembly is in an OFF state, current passes through the illumination assembly to power the indicator light associated with the circuit board.

Figure 4C:
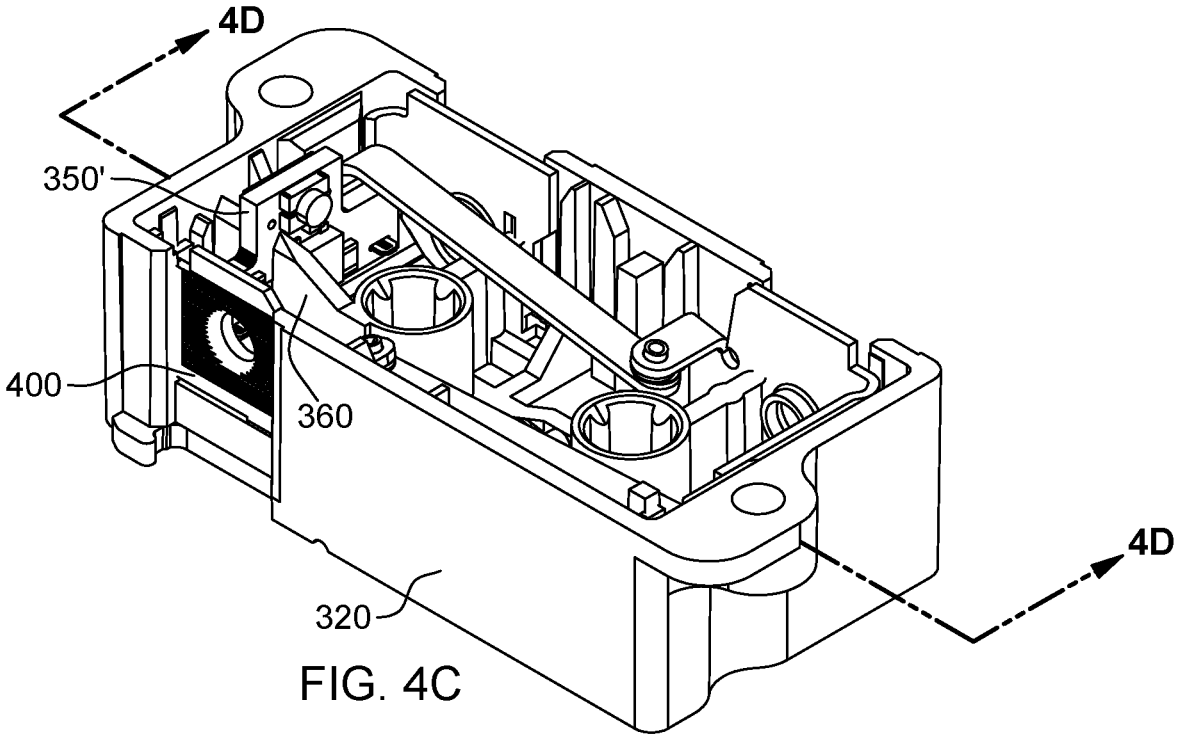
Figure 4D:
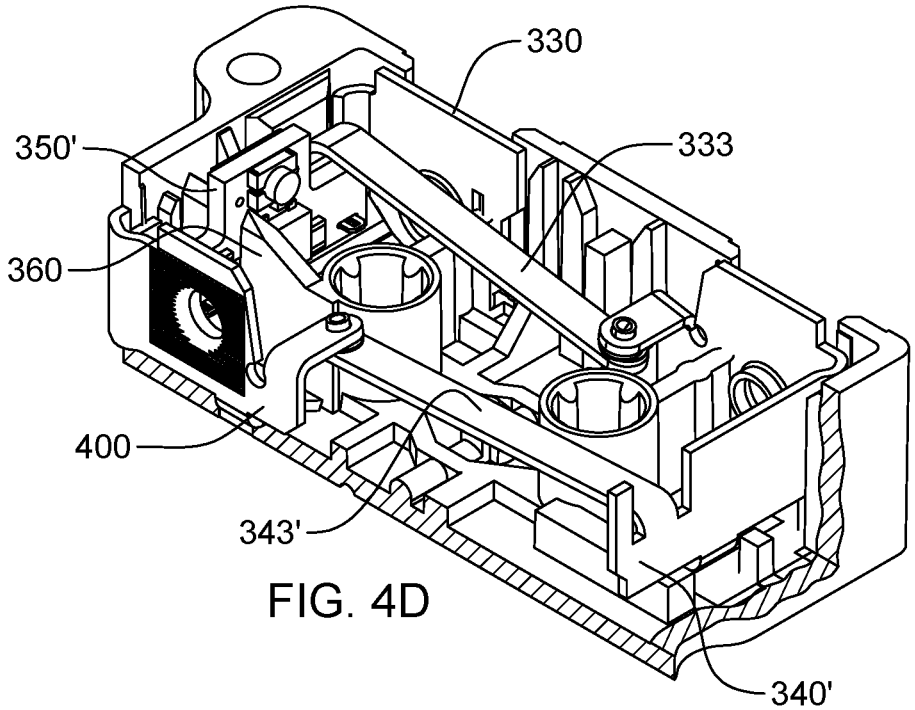

In the embodiment of FIGS. 4A-4G, the illumination assembly is implemented, at least in part, on circuit board 350', which is oriented vertically within the housing, by way of example only. As with the embodiment of FIGS. 3A-3G, a dividing wall or rib 360 within base housing 320 (such as an isolation fin to isolate the first and third terminals), includes a groove 361 sized to receive circuit board 350', such as depicted in FIGS. 4C & 4D. Further, in one embodiment, circuit board 350' includes a groove 358 (see FIG. 4E), sized and configured to receive dividing wall 360 when circuit board 350' is placed or "dropped" in position within base housing 320, as illustrated in FIGS. 4C & 4D. In this configuration, the grooves in circuit board 350' and dividing wall 360 advantageously allow the circuit board to slip over and mechanically couple to dividing wall 360, with the circuit board disposed in a vertical orientation within the housing as shown. Note that, in one embodiment, electrical contact structures 352 are configured so that, by sliding circuit board 350' over dividing wall 360 in operative position within base housing 320 and affixing the cover to the base housing, the electrical contact structures respectively engage and push against lower flange 335 of first terminal 330 and a lower flange (not shown) of third terminal 400, to ensure good electrical connection of the circuit board circuitry to the first and third terminals.

Figure 4E:
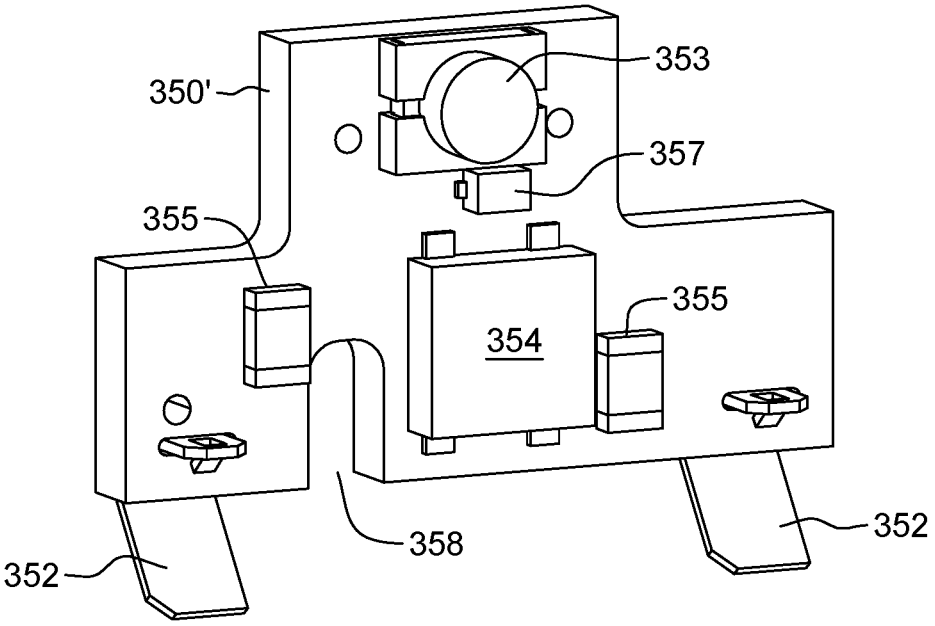

FIG. 4E is an enlarged depiction of one embodiment of circuit board 350', which as shown, is similar to circuit board 350 of the single-pole illuminated toggle switch embodiment of FIGS. 3A-3G. One difference is that circuit board 350' is provided with two similar electrical contact structures 352 (e.g., electrical contact tabs) extending from circuit board 350', which are sized and positioned to electrically contact, for instance, the first and third terminals 330, 400, as noted above. In one or more embodiments, circuit board 350' includes a surface-mount indicator light, such as surface-mount LED indicator light 353, as well as AC-to-DC converter 354, and a current-limiting circuit, which in one embodiment, includes resistors 355, such as resistors R1, R2 described above in connection with FIG. 2. In addition, capacitor 357 can optionally be provided in parallel with indicator light 353, if desired, as described above. In one implementation, circuit board 350' is configured to implement circuitry, such as the illumination assembly 220 circuitry described above in connection with the illuminated electrical load control 200 in FIG. 2 using LED indicator light 353, AC-to-DC converter 354, resistors 355, and optionally capacitor 357.

Note in the three-way illuminated toggle switch embodiment of FIGS. 4A-4G, that the resistors (R1, R2) 355 are of a different resistance value than the resistors (R1, R2) 355 in the single-way illuminated toggle switch embodiment of FIGS. 3A-3G. The current-limiting circuit, and in particular, the resistance values R1, R2, are tailored for the particular switch embodiment in order to achieve the predetermined, low leakage current flow through to the LED lighting load. In particular, resistors 355 for the three-way illuminated toggle switch embodiment are sized to limit leakage current through the illumination assembly to the LED lighting load to below an activation current of the LED lighting load's driver, as discussed herein, while also allowing the indicator lights in two series-connected, three-way switches SW1 and SW2 to illuminate. For instance, with two series-connected, three-way switches SW1 and SW2, resistors 355, implemented in a circuit configuration such as depicted in FIG. 2 for a 120 volt, two-wire service, can each be 15 kΩ or greater for each switch SW1, SW2, in order to ensure that the series leakage current to the LED lighting load is 2 mA, or less. To ensure that the leakage current is 1 mA, or less, then the total resistance through switches SW1, SW2 should be 120 kΩ or greater, meaning that each resistor would have a resistance of 30 kΩ or greater, depending on the desired current flow through the indicator lights, and the predefined, acceptable leakage current level.

Figure 4F:
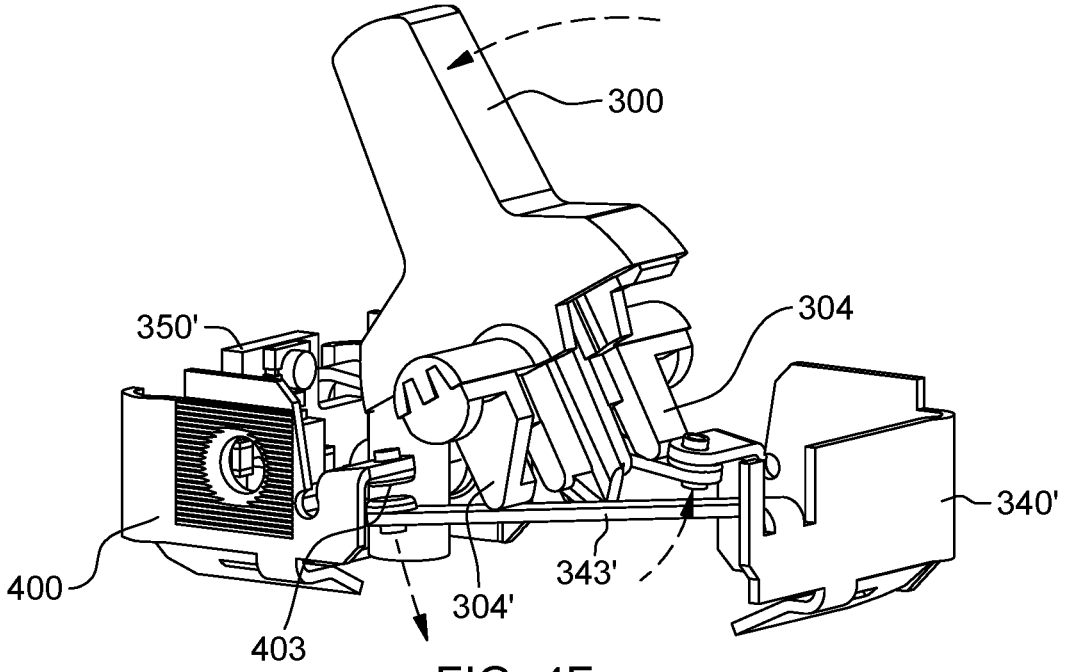
Figure 4G:
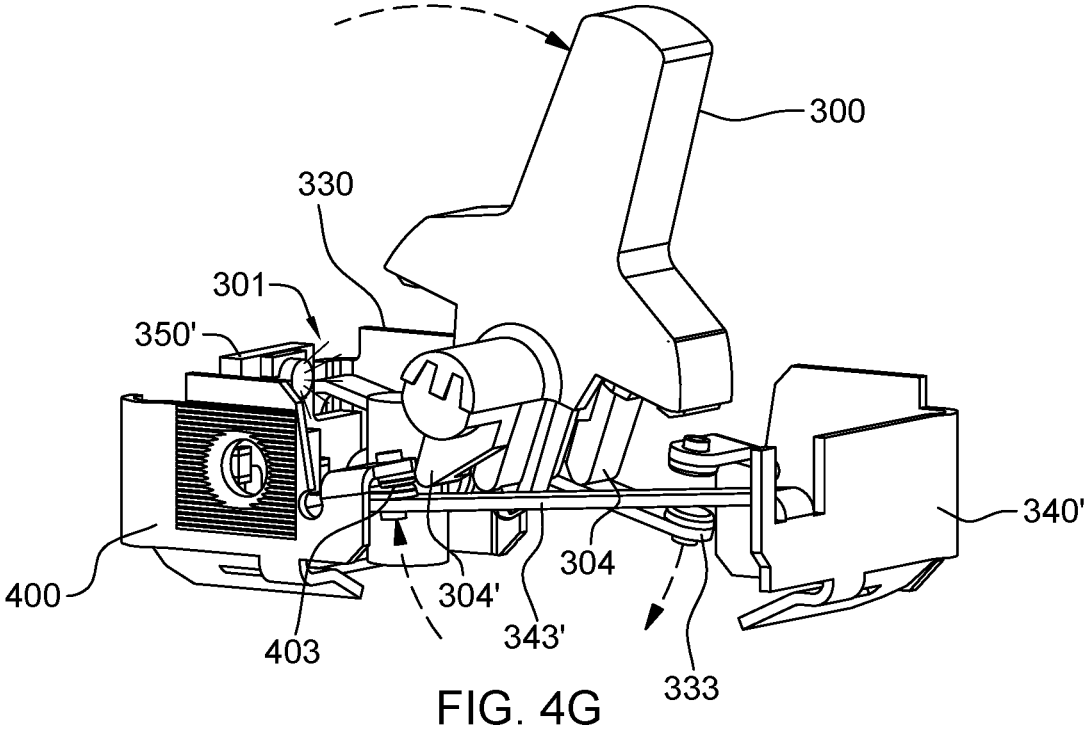

FIGS. 4F & 4G illustrate operation of the three-way, non-neutral-based, illuminated toggle switch embodiment. With transitioning of actuator 300 to a first position, actuator 300 allows movable shorting arm 333 of first terminal 330 to spring into contact with electrical contact 343 of second terminal 340'. In this SW1 state, electrical current is assumed (by way of example) to flow through the electrical switch assembly to the load, and not through the illumination assembly. In FIG. 4G, actuator 300 is transitioned to a second position, pushing shorting arm 333 of first terminal 330 away from electrical contact 343 of second terminal 340', which is assumed to open the electrical switch connection, and transition the three-way electrical switch assembly to an OFF state. In this example, movable shorting arm 343' of second terminal 340' is released by actuator 300 to move (or spring) upward into electrical contact with electrical contact 403 of third terminal 400. In this OFF state, a predetermined, small amount of current is allowed to flow through the illumination assembly as discussed herein to illuminate the indicator light and provide illumination 301 to, for instance, backlight-illuminate the electrical switch assembly, such as the cover, and/or actuator 300, depending on (for example) spacing between components, and/or the selection of materials for the cover and actuator. As noted in connection with FIGS. 3A-3G, if desired, the cover and/or actuator can be manufactured, at least in part, of a translucent material, such as a translucent plastic. Further, if desired, one or more light pipes or other light-conducting or light-directing structures can be utilized within the housing to direct light from the indicator light to the desired location(s) at, for instance, the cover or actuator. In one implementation, light 301 passes through the rim of cover 302 through which actuator 300 extends, as illustrated in FIG. 4G, or passes between the rim of cover 302 and actuator 300.

As described herein, current flow through the illumination assembly in the OFF state is limited by the current-limiting circuit to be too low a current level to activate the driver of the LED lighting load (as described in connection with FIG. 2). In one implementation, the indicator light is a bright or ultrabright LED light through which a small current, for instance, 2 mA or less, such as 1 mA or less (e.g., 0.5 mA or less), is passed, producing sufficient light within the illuminated electrical load control to backlight the switch to assist a user in locating the switch in the dark, while being too low a leakage current level to result in strobing or ghosting at the LED lighting load, as well as too low a level to result in flickering at an LED indicator light of the illumination assembly.

By way of further example, FIGS. 5A-6G depict embodiments of a single-pole and a three-way, non-neutral-based, illuminated rocker switch, in accordance with one or more aspects of the present invention.

Referring first to FIGS. 5A-5G, in a single-pole electrical switch embodiment, one terminal, such as a second terminal T2, is always connected to the power source, and the electrical switch flips between opening and closing the connection of terminal T2 to the first terminal T1 when the actuator is engaged. In the single-pole illuminated switch embodiment, for the indicator light to be ON, and the LED lighting load to be OFF, the switch is in an open state. When in this position, power is directed through the illumination assembly, which as noted, is designed so that only a predetermined, small leakage current (e.g., ≤2 mA) is allowed to pass through to the LED lighting load. For the LED indicator light to be OFF, and the LED lighting load ON, the switch is in a closed state, with second terminal T2 connected to first terminal T1 so that AC power passes directly through the switch assembly to the LED lighting load, and since current flows through the path of least resistance, the indicator light of the illumination assembly is OFF.

The single-way, non-neutral-based, illuminated rocker switch embodiment of FIGS. 5A-5G includes a rocker-type actuator 500 having first and second rocker surfaces 500A, 500B. Actuator 500 is movable or transitionable by a user pushing on the raised first or second rocker surface 500A, 500B, to switch the load control between, for instance, an ON state and an OFF state.

Figure 5A:
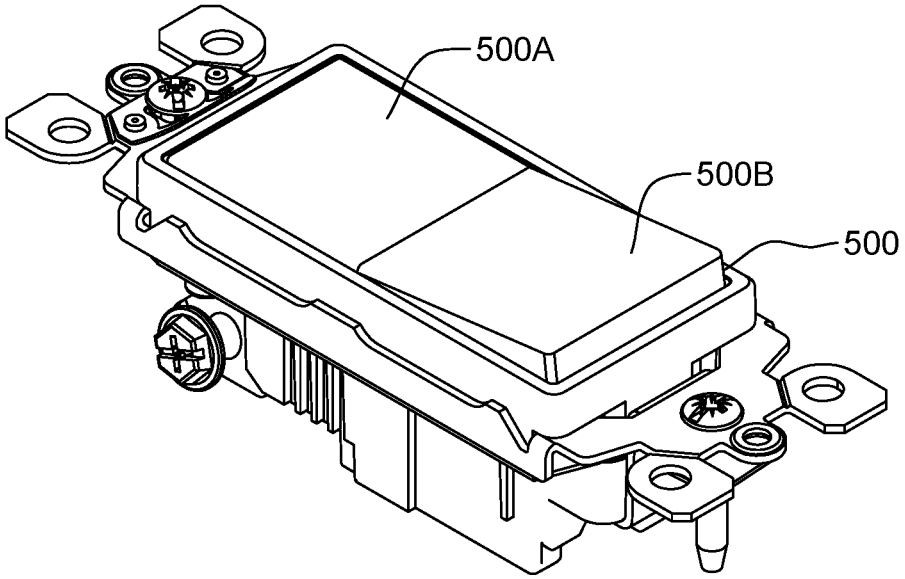
FIGS. 5A-5G depict another embodiment of a single-pole, non-neutral-based, illuminated electrical switch for controlling a light-emitting diode (LED) lighting load, such as an LED light bulb or lamp load, in accordance with one or more aspects of the present invention.
Figure 5B:
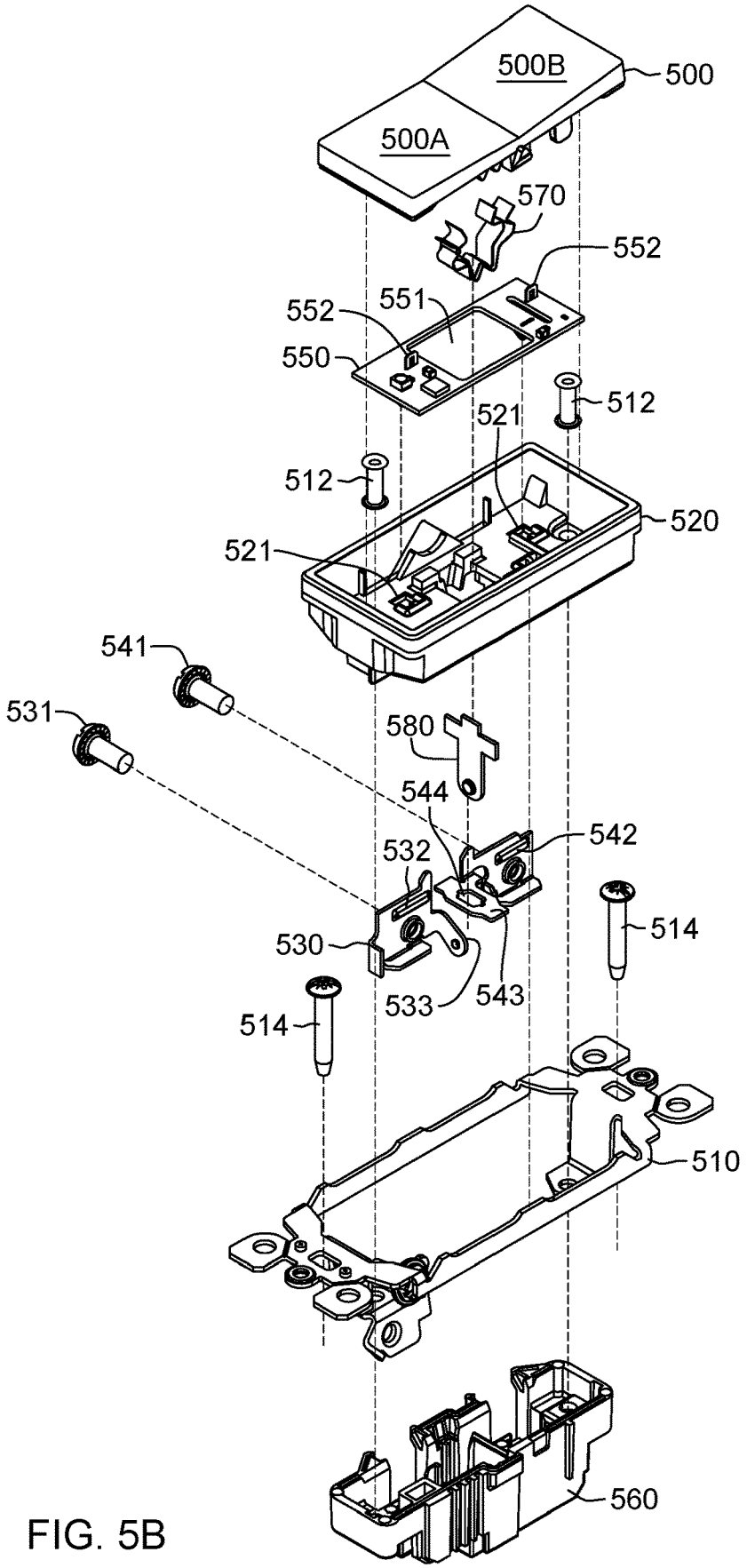
Figure 5C:
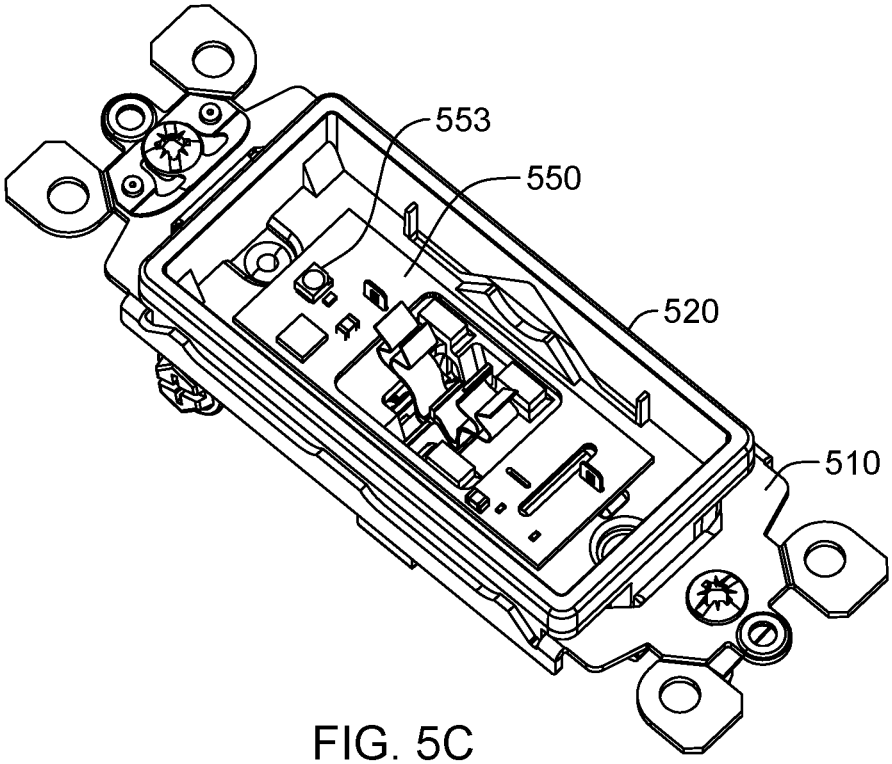
Figure 5D:
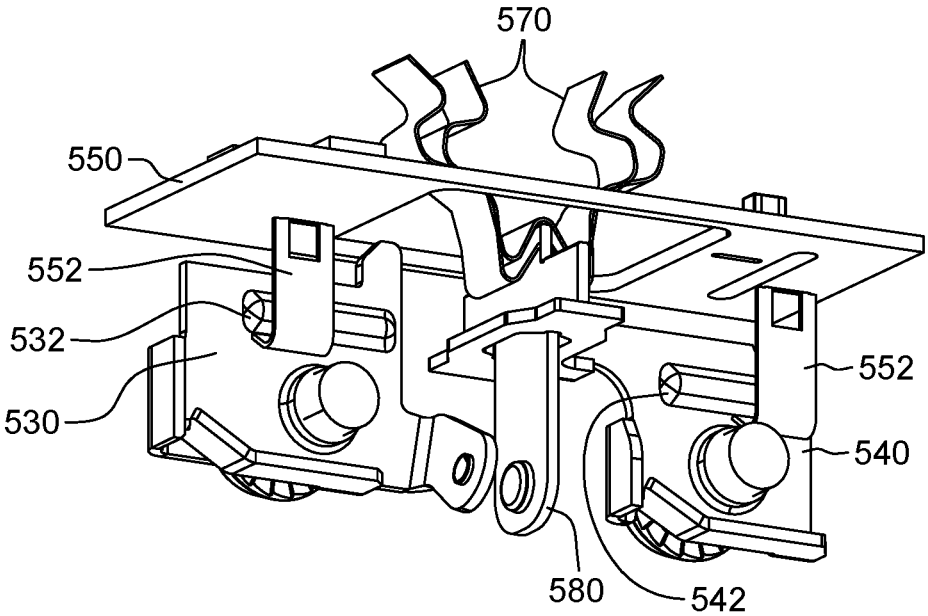

Referring to FIG. 5B, in one embodiment, actuator 500 rests on a spring 570, such as a star spring or over-center spring, which holds an electrical contact 580 that is transitioned as described below, with switching of actuator 500 to open or close the electrical switch. As illustrated in FIG. 5B, a circuit board 550 is provided which implements, at least in part, an illumination assembly such as described above in connection with FIG. 2. In the embodiment depicted, circuit board 550 has a center opening 551 for spring 570 to pass therethrough, and is located within an upper housing 520 that is accommodated by a strapping 510. Upper housing 520 is coupled by one or more fasteners 512 to strapping 510 and a base housing 560. In one embodiment, strapping 510 is used to mount the illustrated assembly via fasteners 514 to a wall box, and upper housing 510 and base housing 560 are formed of an insulative material, with actuator 500 being, for instance, a plastic actuator, and strapping 510 a metal strapping.

As shown in FIG. 5B, the electrical switch assembly of the load control includes a first terminal (T1) 530 and a second terminal (T2) 540, which receive respective terminal fasteners 531, 541, to facilitate, for instance, electrically side-connecting, for instance, the electrical load control in-series between conductors of a two-wire power source, as described above in connection with FIG. 2. As illustrated in FIG. 5B, in one embodiment, first terminal 530 includes a projection or land 532 and second terminal 540 includes a projection or land 542, which are electrically contacted by respective electrical contact structures 552 (see FIGS. 5D & 5E) extending from circuit board 550 through openings 521 in upper housing 520. In the single-way illuminated rocker switch embodiment of FIGS. 5A-5G, contact structures 552 are similarly configured, hook-shaped metal contact structures, configured to engage (e.g., clip onto) and electrically connect to lands 532, 542 of first and second terminals 530, 540 when circuit board 550 is operatively positioned within the housing. In one embodiment, first and second terminals 530, 540, including lands 532, 542, and contact structures 552, are respective metal structures, such as brass or copper structures configured, in one or more embodiments, as illustrated in FIGS. 5A-5G.

In the embodiment illustrated, circuit board 550 of the illumination assembly is oriented horizontally within the housing, residing, by way of example, between actuator 500 and upper housing 520. As shown, circuit board 550 is (in one embodiment) an O-shaped, printed circuit board with a center opening 551 sized to allow for passage of spring 570 through the circuit board. In the embodiment illustrated in FIGS. 5A-5G, spring 570 is engaged by the underside of rocker 500, and holds electrical contact 580, which is configured to extend through an opening 544 in electrical contact 543 of second terminal 540. Electrical contact 580 is connected to spring 570 to move with transition of actuator 500 between the actuator's first and second positions, and in so doing, to open or close electrical contact between first terminal 530 and second terminal 540. In one implementation, spring 570 and electrical contact 580 are respective metal structures, such as respective brass or copper structures.

Figure 5E:
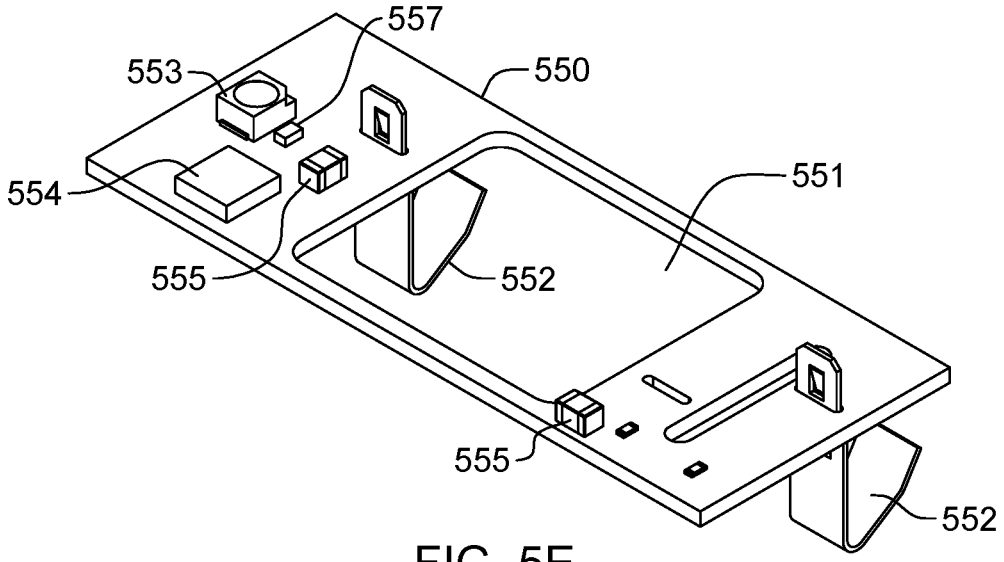

FIG. 5E is an enlarged depiction of one embodiment of circuit board 550, with metal contact structures 552 shown extending downward from circuit board 550 to facilitate connecting the circuit board to the first and second terminals, as noted. In the embodiment depicted, circuit board 550 includes a surface-mount indicator light, such as a surface-mount LED indicator light 553, as well as an AC-to-DC converter 554, and a current-limiting circuit, which can include (in one embodiment) first and second resistors 555, such as resistors R1, R2 connected in a current-limiting circuit as described above in connection with FIG. 2. In addition, a capacitor 557 can optionally be provided in parallel with the indicator light, as discussed above in connection with FIG. 2. As noted, circuit board 550 is configured to implement an illumination assembly such as described above in connection with the illuminated electrical load control of FIG. 2, in one embodiment. In particular, in one embodiment, resistors 555 mounted to circuit board 550 are resistors R1, R2 of the current-limiting circuit of the illumination assembly described above. Resistance values for resistors 550 are selected so that a minimal, predetermined current flows through the indicator light and leaks to the LED lighting load when the electrical switch assembly is in the OFF state. For instance, leakage current of 2 mA or below is obtained by implementing a series resistance (R1, R2) of over 60 kΩ for a standard 120 volt service, and leakage current of 1 mA or below can be obtained by implementing a series resistance (R1, R2) totaling 120 kΩ, or greater.

Figure 5F:
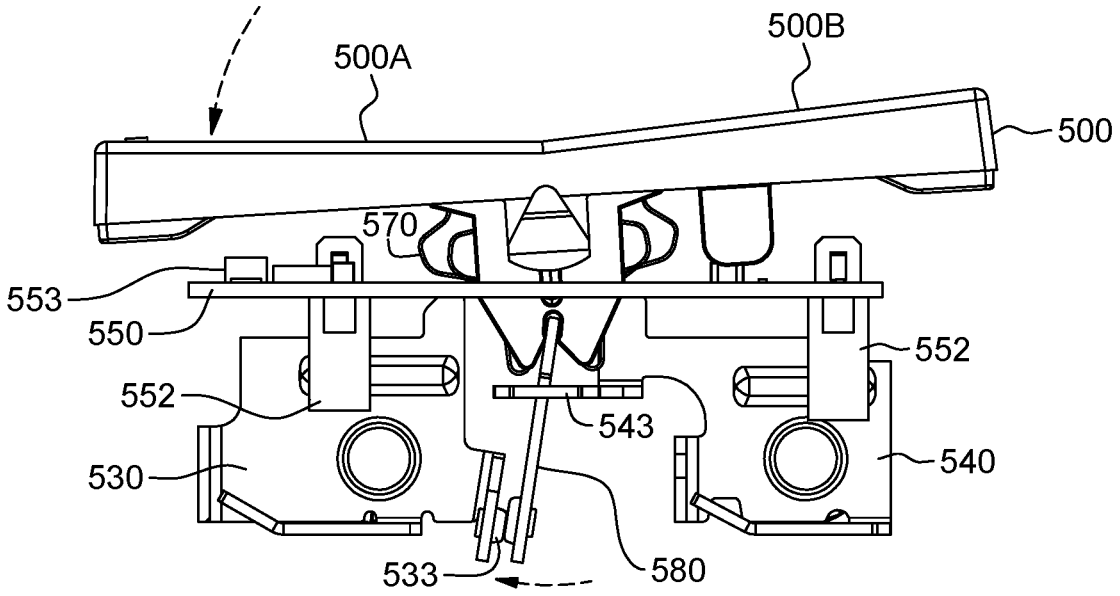
Figure 5G:
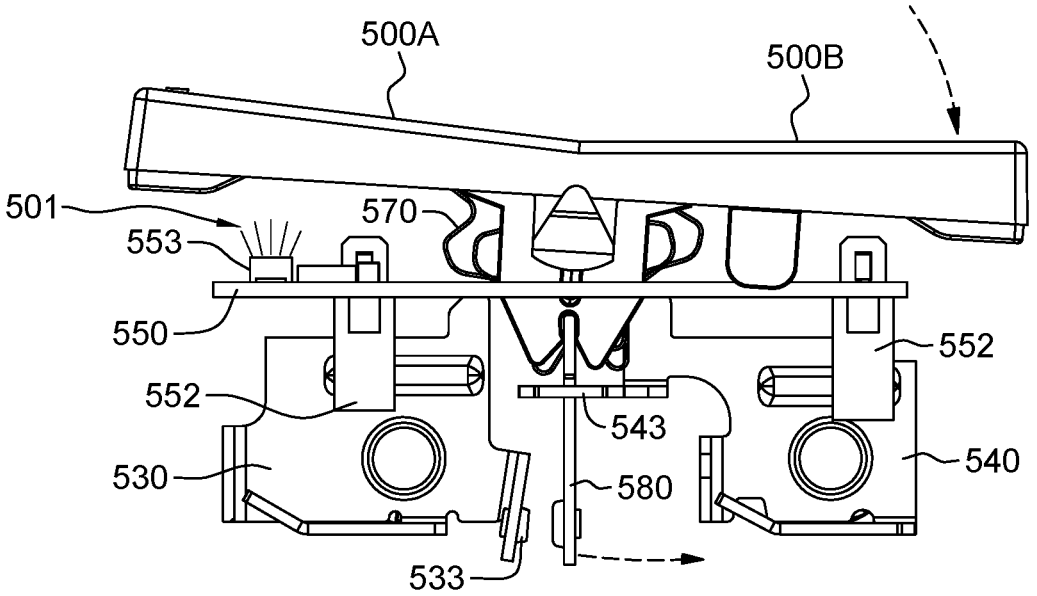

FIGS. 5F & 5G illustrate operation of the single-way, non-neutral-based illuminated rocker switch. With transitioning of actuator 500 to an ON position, the entrained electrical contact 580 is moved as illustrated in FIG. 5F, to electrically connect first terminal 530, via contact with electrical contact 533, and second terminal 540, via contact with electrical contact 543. In this ON state, electrical current flows directly through the electrical switch assembly to the load, and not through the illumination assembly. In FIG. 5G, actuator 500 is switched to the OFF state, moving electrical contact arm 580 to open the contact with electrical contact 533 of first terminal 530. In this OFF state, a predetermined, small amount of current is allowed by the current-limiting circuit of the illumination assembly to flow through the illumination assembly, with the amount of current being preselected as sufficient to illuminate the indicator light and provide illumination 501 to, for instance, a portion of actuator 500, or a portion of upper housing 520 within which actuator 500 resides. As noted, current through the illumination assembly is at a predetermined, low current level sufficient to illuminate the indicator light, while being insufficient to activate the driver of the LED lighting load, as described above in connection with FIG. 2. Note that if desired, actuator 500 and/or upper housing 520 can be manufactured, at least in part, of a translucent material, such as a translucent plastic. Further, if desired, one or more light pipes or other light-conducting or light-directing structures can be utilized within the housing to direct light from the indicator light to the desired location at, for instance, the actuator or cover. In one embodiment, actuator 500 can include one or more thinned or recessed regions on the underside of the actuator to assist in light passing therethrough.

FIGS. 6A-6G depict one embodiment of a three-way, non-neutral-based, illuminated rocker switch for controlling a light-emitting diode (LED) lighting load, such as an LED light bulb or lamp, as described herein. Unless otherwise indicated, components of the three-way illuminated toggle switch embodiment of FIGS. 6A-6G are similar or identical to the single-pole illuminated toggle switch embodiment described above in connection with FIGS. 5A-5G. One difference is that, in a three-way switch configuration, two three-way switches (SW1, SW2) are electrically coupled in-series with the LED lighting load.

As shown in FIGS. 6A-6G, the three-way, non-neutral-based illuminated toggle switch embodiment includes first terminal T1 530, second terminal T2 540, and a third terminal T3 600, each of which accommodates respective fasteners 531, 541, 601, which facilitate, for instance, electrically side-connecting two-wire premise wiring to the illuminated switch (SW1) in a three-way wired configuration with another illuminated switch (SW2). In this three-way switch embodiment, moving actuator 500 switches electrical contact 580 between connecting second terminal 540 and first terminal 530 to connecting second terminal 540 and third terminal 600.

Figure 6A:
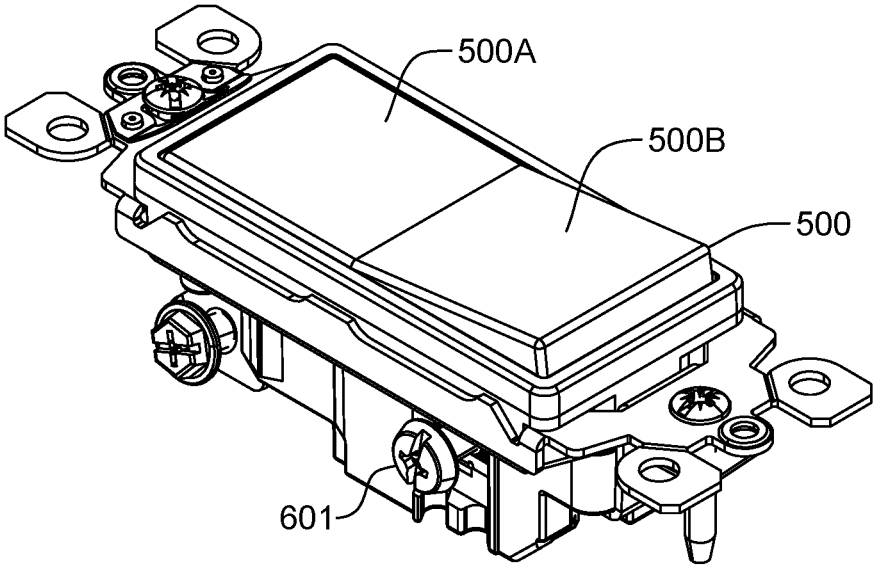
FIGS. 6A-6G depict another embodiment of a three-way, non-neutral-based, illuminated electrical switch for controlling a light-emitting diode (LED) lighting load, such as an LED light bulb or lamp load, in accordance with one or more aspects of the present invention.
Figure 6B:
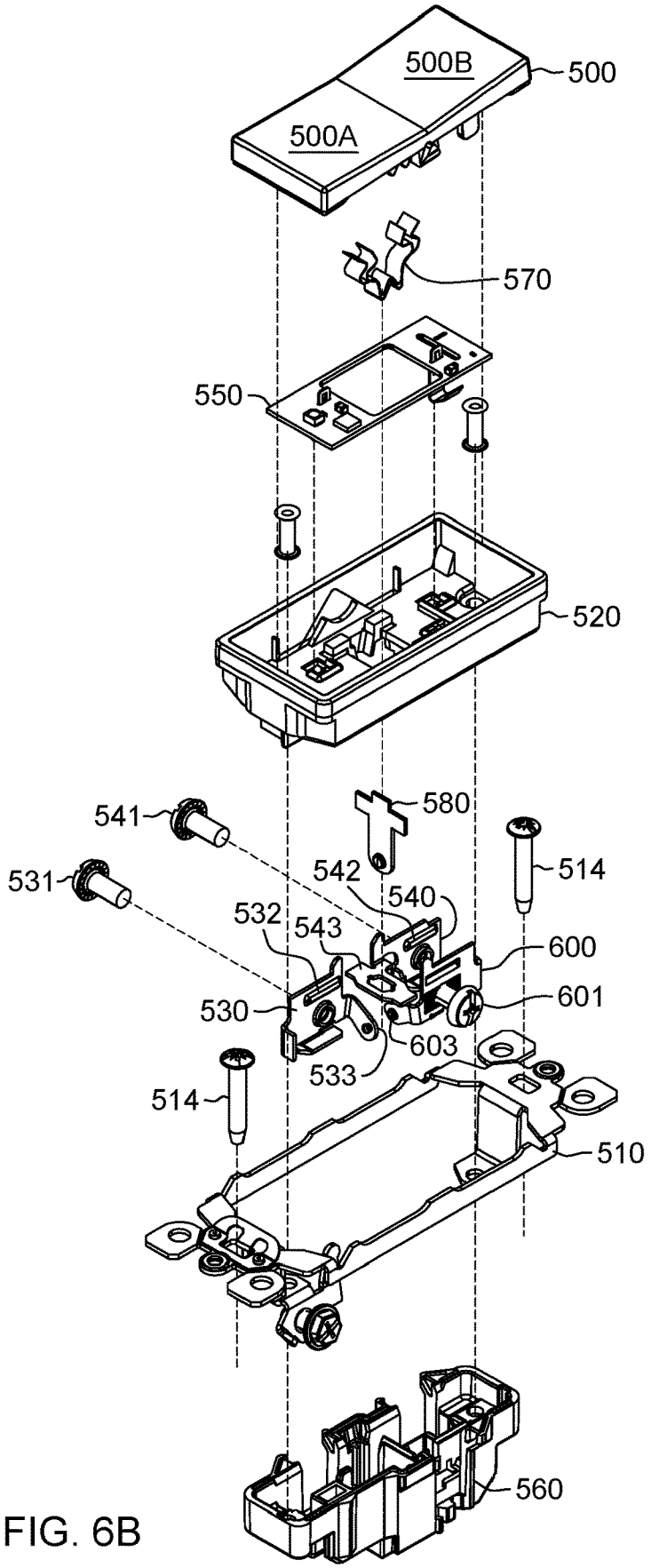

As shown in FIG. 6B, the three-way, non-neutral-based, illuminated rocker switch embodiment is similar to the single-pole, non-neutral-based, illuminated rocker switch embodiment of FIG. 5B. One difference is the inclusion of a third terminal 600 with a respective terminal fastener 601 and electrical contact 603.

Figure 6C:
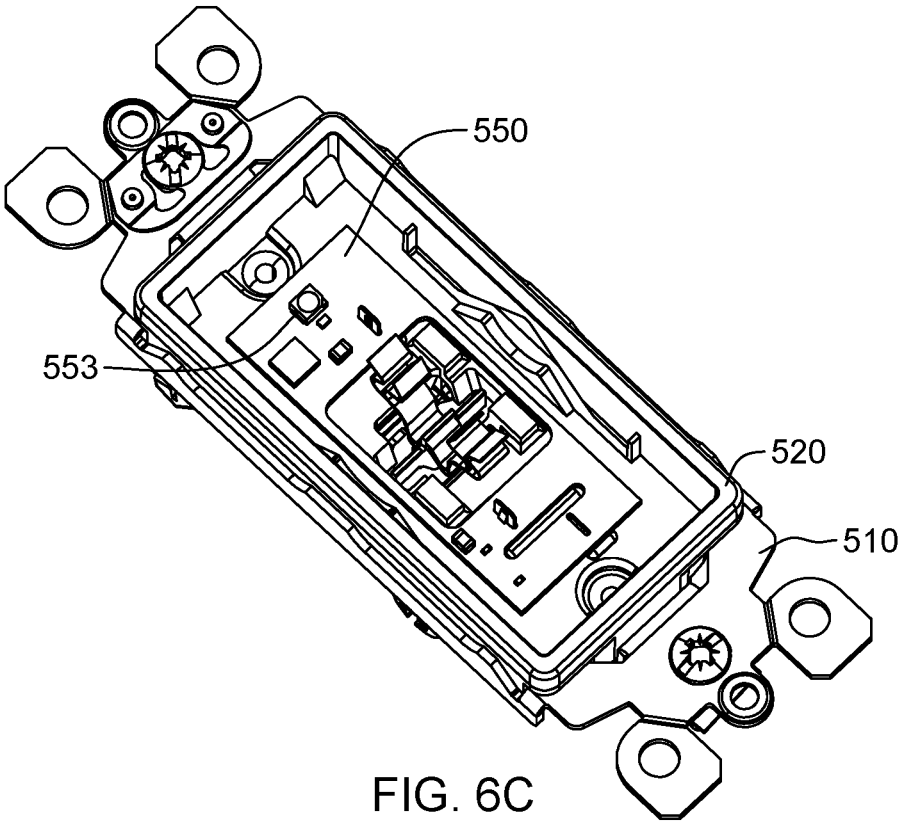
Figure 6D:
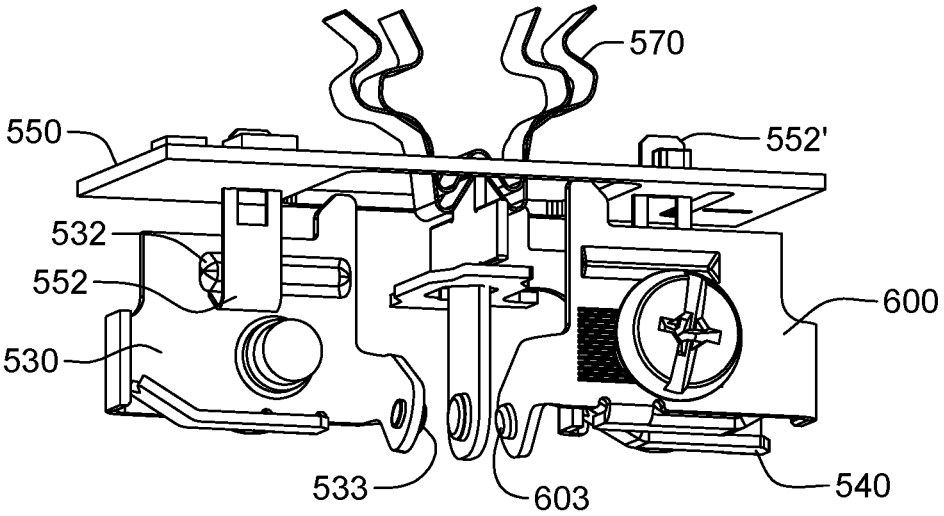

As partially illustrated in FIGS. 6C-6D, first terminal 530 and third terminal 600 include respective projections or lands 532, which are electrically contacted by respective electrical contacts 552, 552' (e.g., electrical contact hooks or clips) extending from circuit board 550' through respective openings in upper housing 520 to electrically couple the circuitry of the illumination assembly in parallel with the electrical switch assembly. In the three-way illuminated toggle switch embodiment depicted, electrical contact structures 552, 552' are electrically, operatively coupled to power the circuitry of circuit board 550'. Note that, in one embodiment, circuit board 550' is a printed circuit board, such as a single-layer, printed circuit board, implementing an illumination assembly similar to that described above in connection with FIG. 2. As with circuit board 550 of FIGS. 5A-5G, circuit board 550' is coupled so that when the electrical switch assembly is in an OFF state, current passes through the illumination assembly to power the switch's indicator light, as explained.

Figure 6E:
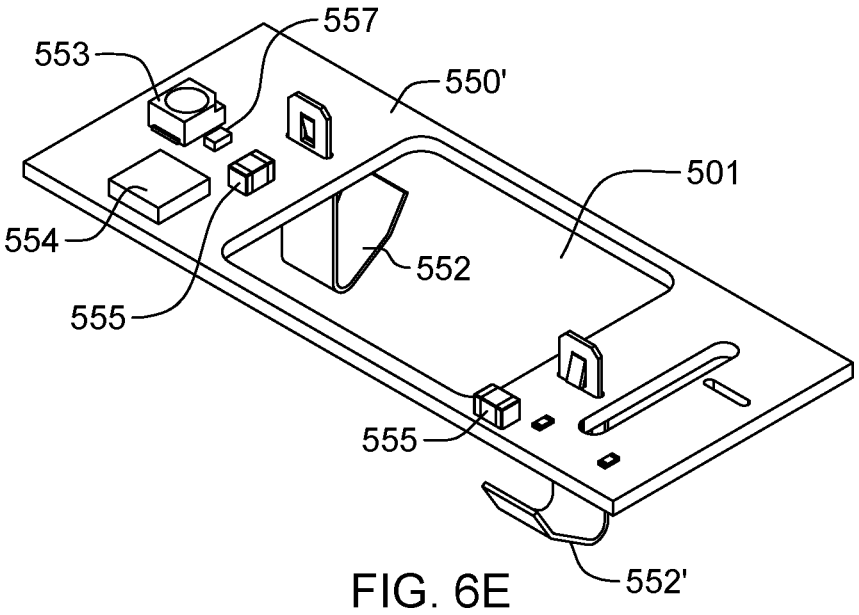

FIG. 6E is an enlarged depiction of one embodiment of circuit board 550', which as shown, is similar to circuit board 550 of the single-pole illuminated rocker switch embodiment of FIGS. 5A-5G. One difference is that 550' is provided with an electrical contact 552', oriented and configured to contact a projection or land on an inward-facing surface of third terminal 600 to electrically connect circuit board 550' to the first and third terminals 530, 600. In one or more embodiments, circuit board 550' also includes a surface-mount indicator light, such as surface-mount LED indicator light 553, an AC-to-DC converter 554, and a current-limiting circuit, which in one embodiment, includes resistors 555, such as resistors R1, R2 described above in connection with FIG. 2. In addition, capacitor 557 can optionally be provided in parallel with indicator light 553, if desired, as described above. In one implementation, circuit board 550' is configured to implement circuity, such as the illumination assembly 220 circuity described above in connection with illuminated electrical load control 200 of FIG. 2, using LED indicator light 553, AC-to-DC converter 554, resistors 555, and optionally capacitor 557.

Note that in the three-way illuminated rocker switch embodiment of FIGS. 6A-6G, resistors (R1, R2) 555 are of different resistance values than the resistors (R1, R2) 555 in the single-way illuminated rocker switch embodiment of FIGS. 5A-5G. Resistance through the current-limiting circuit, and in particular, the resistance values R1, R2, are tailored for the particular switch embodiment in order to achieve the desired predetermined, low-leakage current flow through to the LED lighting load when the switch is in the OFF state. For instance, resistor 555 values for the three-way illuminated rocker switch embodiment are approximately half the resistance size of the single-pole embodiment, to limit leakage current through the illumination assembly to the LED lighting load to below an activation current of the LED lighting load's driver, as discussed, while also allowing the indicator lights in two series-connected, three-way switches (S1, S2) to illuminate.

Figure 6F:
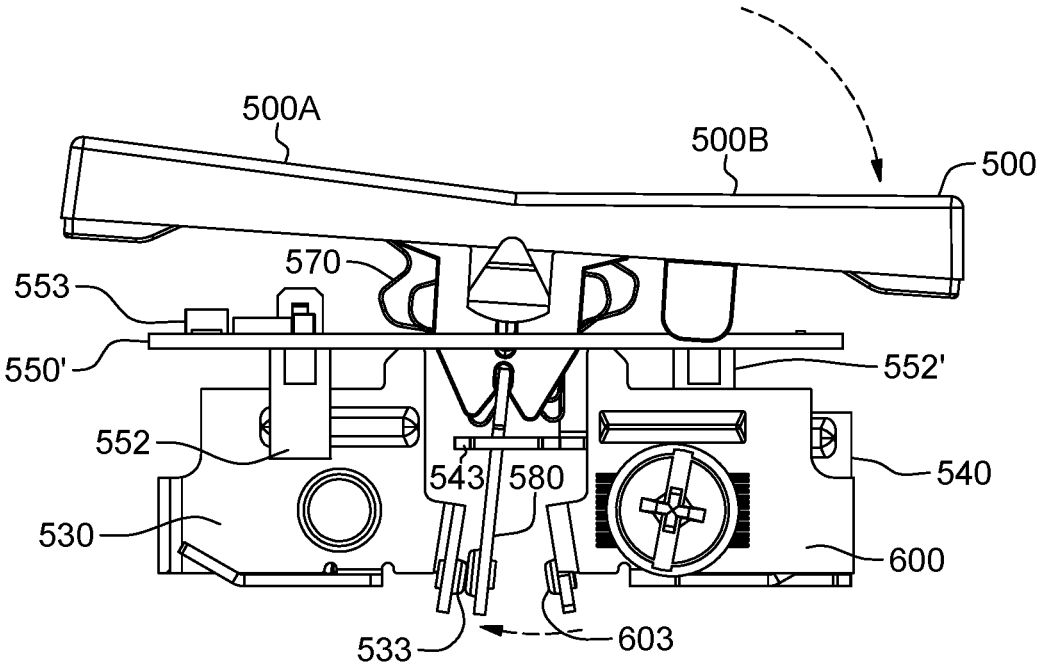
Figure 6G:
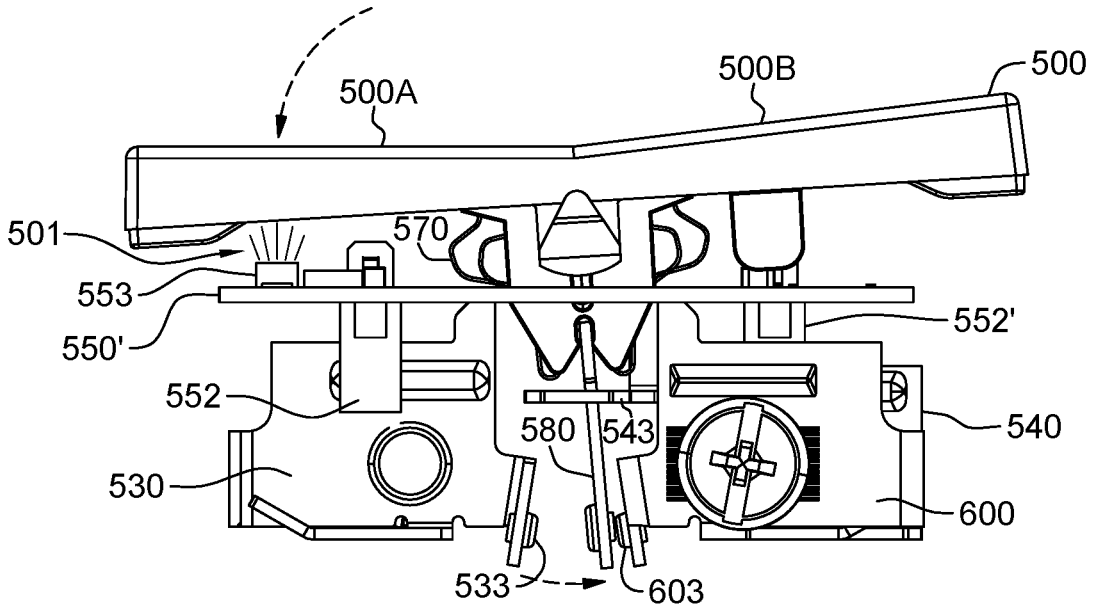

FIGS. 6F & 6G illustrate operation of the three-way, non-neutral-based, illuminated rocker switch. With transitioning of actuator 500 to a first position, actuator 500 moves electrical contact 580 to connect electrical contact 533 of first terminal 530 to electrical contact 543 of second terminal 540, as shown in FIG. 6F. In this SW1 state, electrical current is assumed (by way of example) to flow through the electrical switch assembly to the load, and not through the illumination assembly. In FIG. 6G, actuator 500 is transitioned to a second position, moving electrical contact 580 away from electrical contact 533 of first terminal 530, and into contact with electrical contact 603 of third terminal 600 to electrical contact 543 of second terminal 540. In this OFF state, a predetermined, small amount of current is allowed to flow through the illumination assembly to illuminate the indicator light and provide illumination 501 to, for instance, back-light illuminate actuator 500 and/or a portion of upper housing 520 within which actuator 500 resides. As explained, the predetermined current level through the illumination assembly is too low a leakage current level to activate the driver of the LED lighting load, thereby avoiding strobing or ghosting of the LED lighting load, and in one or more embodiments, is also low enough to prevent flickering of the indicator light.

Those skilled in the art will note from the above discussion that provided herein is an illumination assembly circuit which features an illumination indicator that passes current through to an LED lamp and/or load when the electrical control is in an OFF state or position, and which addresses existing industry issues with using non-neutral-based illuminated electrical load controls with LED lighting loads. The first problem addressed is ghosting and strobing at the LED light load, which is when the LED lamp load still has sufficient current supplied to it through the illumination circuit to prevent it from turning OFF load illumination completely (ghosting), or the LED lighting load might pulsate (or strobe) when the electrical load control is in the OFF state. The resolution disclosed herein for a two-wire, 120 volt service is for a series resistance that leads to the LED lighting load through the illumination assembly to be over 60 kΩ, so that the leakage current is 2 mA or below. At this low current level, it has been found that substantially all commercially available LED light bulbs and lamps will not strobe or ghost.

The second issue addressed herein is to eliminate any flickering at the indicator light of the illumination assembly due to the LED load circuit driver(s) being current-starved. When current-starved, the LED driver(s) continue to charge up and then attempt to turn the LED load ON. During this processing, the LED lighting load draws sufficient current so that there is a voltage drop across the load, and in turn this causes the indicator intensity light to alter and to appear to flicker because the indicator circuit has fixed impedance, and if the voltage across it changes, then the current to the illuminated circuit changes, hence, the current to the illumination indictor dips and recovers, and the cycle repeats, which from a user's perspective, looks as if the indicator is flickering. To resolve this flicker issue, leakage current through to the LED lighting load is further reduced to, for instance, 1 mA or less, by increasing the total series resistance to 120 kΩ or greater through the illumination assembly (assuming a standard U.S. voltage of 120 volts). At this level, the indicator circuit suppresses any attempt to activate most all available LED light bulbs and lamps.

By ensuring that the leakage current through the illumination assembly is 1 mA or less, the strobing and ghosting issues at the LED lighting load, as well as the flicker issue at the indicator light, are addressed. This can be accomplished by selecting the appropriate AC-to-DC converter to ensure that it conducts at such a low current level, and selecting an LED indicator light bright enough at the low current level to illuminate the desired load control surface. For instance, an LED indicator light can be a light capable of producing illuminated intensity of 1000 mcd (millicandela) or more, at a test current level of 5 mA. However, in operation, the illumination intensity is less, being driven at a very low current, as explained herein. Also, depending on the application of the intensity, or how much light is desired, the millicandela (or lux level) can be varied. A goal for the LED selection is to have the part's dye (silicone dye) turn ON most, if not all, of the dye.

Depending on the implementation, the new illumination circuitry disclosed could be a mechanical packaging challenge. Advantageously, embodiments are disclosed herein which fit this new circuit into existing devices with minimal mechanical changes. This is accomplished, in part, by using very small components and a small circuit board. An assembly is disclosed that fits into the existing switch designs, using electrical contacts to connect power, and which positions the surface mount LED in a precise location to optimize light output. LEDs tend to be very directional so the precise locating of the LED is advantageous to making the light appearance similar to existing products, thereby meeting customer expectations. The circuit board's power contact structures disclosed result in a significant reduction in final assembly labor time as well as an increase in end product reliability. Also, the same circuit board designs can be utilized in different style switches, as well as other format switches. As noted, a same circuit board can be used in single-way, 3-way and 4-way switches by altering the circuit resistance in order to create similar light intensity between all of the devices, with the predetermined low leakage current through to the LED lighting load.

Using the concepts disclosed herein, alternative embodiments also can apply to two-wire dimmers, occupancy sensors and additional lighting controls that utilize an indicator LED and face the same 'ghosting' challenges.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. A non-neutral-based, illuminated electrical load control for controlling a source of AC electrical power to a light-emitting diode (LED) lighting load, the non-neutral-based, illuminated electrical load control comprising:

a wall-box mounted housing;

an electrical switch assembly disposed at least partially within the wall-box mounted housing, the electrical switch assembly comprising:

an actuator coupled to transition the electrical switch assembly between an ON state and an OFF state, where AC current flows to the LED lighting load in the ON state, and is interrupted from flowing to the LED lighting load in the OFF state; and an illumination assembly associated with the electrical switch assembly, the illumination assembly comprising:

an indicator light that illuminates, at least in part, the non-neutral, illuminated electrical load control when the electrical switch assembly is in the OFF state; and a current-limiting circuit configured to limit leakage current through the illumination assembly to the LED lighting load to below an activation current of the LED lighting load when the electrical switch assembly is in the OFF state and the indicator light provides illumination.

2. The non-neutral-based, illuminated electrical load control of claim 1, wherein the illumination assembly is coupled in parallel with the electrical switch assembly.

3. A non-neutral-based, illuminated electrical load control for controlling a source of AC electrical power to a light-emitting diode (LED) lighting load, the non-neutral-based, illuminated electrical load control comprising:

a wall-box mounted housing;

an electrical switch assembly disposed at least partially within the wall-box mounted housing, the electrical switch assembly comprising:

an actuator coupled to transition the electrical switch assembly between an ON state and an OFF state, where AC current flows to the LED lighting load in the ON state, and is interrupted from flowing to the LED lighting load in the OFF state; and an illumination assembly associated with the electrical switch assembly, the illumination assembly comprising:

an indicator light that illuminates, at least in part, the non-neutral, illuminated electrical load control when the electrical switch assembly is in the OFF state; and a current-limiting circuit configured to limit leakage current through the illumination assembly to the LED lighting load to below an activation current of the LED lighting load when the electrical switch assembly is in the OFF state and the indicator light provides illumination; and wherein the electrical switch assembly further comprises:

a line terminal to electrically connect to a line conductor of the source of AC electrical power;

a switched terminal to electrically connect to facilitate supplying electrical power to the LED lighting load;

wherein AC current flows between the line terminal and the switched terminal in the ON state, and is interrupted from flowing between the line terminal and the switch terminal in the OFF state; and wherein the current-limiting circuit is in series-electrical connection between the line terminal and the switched terminal of the electrical switch assembly.

4. The non-neutral, illuminated electrical load control of claim 3, wherein the indicator light illuminates, at least in part, the electrical switch assembly when the electrical switch assembly is in the OFF state.

5. The non-neutral, illuminated electrical load control of claim 4, wherein the indicator light backlight illuminates, at least in part, at least one of a cover or the actuator of the electrical switch assembly when the electrical switch assembly is in the OFF state.

6. The non-neutral, illuminated electrical load control of claim 3, wherein the current-limiting circuit is configured to limit leakage current through the illumination assembly to the LED lighting load to below an activation current of a driver of the LED lighting load when the electrical switch assembly is in the OFF state and the indicator light provides illumination.

7. The non-neutral, illuminated electrical load control of claim 3, wherein the current-limiting circuit limits leakage current through the illumination assembly to the LED lighting load to 2 mA or less when the electrical switch assembly is in the OFF state and the indicator light provides illumination.

8. The non-neutral, illuminated electrical load control of claim 3, wherein the current-limiting circuit limits leakage current through the illumination assembly to the LED lighting load to 0.5 mA or less when the electrical switch assembly is in the OFF state and the indicator light provides illumination.

9. A non-neutral-based, illuminated electrical load control for controlling a source of AC electrical power to a light-emitting diode (LED) lighting load, the non-neutral-based, illuminated electrical load control comprising:

a wall-box mounted housing;

an electrical switch assembly disposed at least partially within the wall-box mounted housing, the electrical switch assembly comprising:

an actuator coupled to transition the electrical switch assembly between an ON state and an OFF state, where AC current flows to the LED lighting load in the ON state, and is interrupted from flowing to the LED lighting load in the OFF state; and an illumination assembly coupled in parallel with the electrical switch assembly, the illumination assembly comprising:

a light-emitting diode (LED) indicator light that illuminates, at least in part, the non-neutral, illuminated electrical load control when the electrical switch assembly is in the OFF state;

a current-limiting circuit electrically configured to limit leakage current through the illumination assembly to the LED lighting load to below an activation current of the LED lighting load when the electrical switch assembly is in the OFF state and the indicator light provides illumination; and an AC-to-DC converter providing a DC current to the LED indicator light when the electrical switch assembly is in the OFF state and the indicator light provides illumination.

10. A non-neutral-based, illuminated electrical load control for controlling a source of AC electrical power to a light-emitting diode (LED) lighting load, the non-neutral-based, illuminated electrical load control comprising:

a wall-box mounted housing;

an electrical switch assembly disposed at least partially within the wall-box mounted housing, the electrical switch assembly comprising:

an actuator coupled to transition the electrical switch assembly between an ON state and an OFF state, where AC current flows to the LED lighting load in the ON state, and is interrupted from flowing to the LED lighting load in the OFF state; and an illumination assembly associated with the electrical switch assembly, the illumination assembly comprising:

a light-emitting diode (LED) indicator light that illuminates, at least in part, the non-neutral, illuminated electrical load control when the electrical switch assembly is in the OFF state;

a current-limiting circuit configured to limit leakage current through the illumination assembly to the LED lighting load to below an activation current of the LED lighting load when the electrical switch assembly is in the OFF state and the indicator light provides illumination; and an AC-to-DC converter providing a DC current to the LED indicator light when the electrical switch assembly is in the OFF state and the indicator light provides illumination; and wherein the current-limiting circuit further comprises a first resistor and a second resistor, the first resistor being electrically coupled between a first terminal of the electrical switch assembly and the AC-to-DC converter, and the second resistor being electrically coupled between a second terminal of the electrical switch assembly and the AC-to-DC converter.

11. The non-neutral, illuminated electrical load control of claim 10, wherein the DC current to the LED indicator light is limited by the current-limiting circuit to one 1 mA or less, and the LED indicator light has an illuminated intensity of 1000 mcd or greater, with a 5 mA DC test current to the LED indicator light.

12. The non-neutral, illuminated electrical load control of claim 10, wherein the first resistor and the second resistor are of an equal resistance.

13. A non-neutral-based, illuminated electrical load control for controlling a source of AC electrical power to a light-emitting diode (LED) lighting load, the non-neutral-based, illuminated electrical load control comprising:

a wall-box mounted housing;

an electrical switch assembly disposed at least partially within the wall-box mounted housing, the electrical switch assembly comprising:

an actuator coupled to transition the electrical switch assembly between an ON state and OFF state, where AC current flows to the LED lighting load in the ON state, and is interrupted from flowing to the LED lighting load in the OFF state; and an illumination assembly coupled in parallel with the electrical switch assembly, the illumination assembly comprising:

a circuit board disposed within the wall-box mounted housing;

an indicator light that illuminates, at least in part, the non-neutral, illuminated electrical load control when the electrical switch assembly is in the OFF state, the indicator light being coupled to the circuit board; and a current-limiting circuit configured to limit leakage current through the illumination assembly to the LED lighting load to below an activation current of the LED lighting load when the electrical switch assembly is in the OFF state and the indicator light provides illumination.

14. The non-neutral, illuminated electrical load control of claim 13, wherein the indicator light comprises a light-emitting diode (LED) indicator light, and the illumination assembly further comprises an AC-to-DC converter, the AC-to-DC converter providing a DC current to the LED indicator light coupled to the circuit board when the electrical switch assembly is in the OFF state and the indicator light provides illumination, the DC current to the LED indicator light being limited by the current-limiting circuit is 1 mA or less.

15. The non-neutral, illuminated electrical load control of claim 14, wherein the current-limiting circuit comprises a first resistor and a second resistor, the first resistor being electrically coupled between a first terminal of the electrical switch assembly and the AC-to-DC converter, and the second resistor being electrically coupled between a second terminal of the electrical switch assembly and the AC-to-DC converter, and wherein the first resistor and the second resistor are of an equal resistance.

16. The non-neutral, illuminated electrical load control of claim 13, wherein the actuator is a toggle-type actuator movable by a user to transition the electrical switch assembly between the OFF state and an ON state, and wherein the circuit board is oriented transverse to a cover of the electrical switch assembly.

17. The non-neutral, illuminated electrical load control of claim 16, wherein the circuit board includes a groove sized to receive, at least in part, a dividing wall within the housing to facilitate orienting and holding the circuit board in position within the housing over, at least in part, the dividing wall.

18. The non-neutral, illuminated electrical load control of claim 16, wherein the illumination assembly further comprises at least one electrical contact extending from the circuit board and electrically connecting the circuit board to at least one terminal of the electrical switch assembly, the electrical contact further facilitating maintaining the circuit board in position by physically contacting the at least one terminal of the electrical switch assembly.

19. The non-neutral, illuminated electrical load control of claim 13, wherein the actuator is a rocker-type actuator movable by a user to transition the electrical switch assembly between the OFF state and the ON state, and wherein the circuit board is oriented parallel to the rocker-type actuator.

20. The non-neutral, illuminated electrical load control of claim 19, wherein the circuit board includes a central opening through which one or more components of the electrical switch assembly extend.

21. The non-neutral, illuminated electrical load control of claim 19, wherein the illumination assembly further comprises a first electrical contact extending from the circuit board and electrically connecting the circuit board to a first terminal of the electrical switch assembly, and a second electrical contact extending from the circuit board and electrically connecting the circuit board to a second terminal of the electrical switch assembly.

* * * * *